US010242679B2

(12) United States Patent
Sung et al.

(10) Patent No.: US 10,242,679 B2
(45) Date of Patent: Mar. 26, 2019

(54) METHOD AND APPARATUS FOR PACKET LOSS CONCEALMENT, AND DECODING METHOD AND APPARATUS EMPLOYING SAME

(71) Applicant: SAMSUNG ELECTRONICS CO., LTD., Suwon-si (KR)

(72) Inventors: Ho-sang Sung, Yongin-si (KR); Eun-mi Oh, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 20 days.

(21) Appl. No.: 15/500,264

(22) PCT Filed: Jul. 28, 2015

(86) PCT No.: PCT/IB2015/001782
§ 371 (c)(1),
(2) Date: Apr. 28, 2017

(87) PCT Pub. No.: WO2016/016724
PCT Pub. Date: Feb. 4, 2016

(65) Prior Publication Data

US 2017/0256266 A1 Sep. 7, 2017

Related U.S. Application Data

(60) Provisional application No. 62/029,708, filed on Jul. 28, 2014.

(51) Int. Cl.
*G10L 19/005* (2013.01)
*G10L 19/012* (2013.01)
(Continued)

(52) U.S. Cl.
CPC ..... *G10L 19/005* (2013.01); *G10L 19/012* (2013.01); *G10L 19/022* (2013.01); *G10L 19/0204* (2013.01); *G10L 25/21* (2013.01)

(58) Field of Classification Search
CPC ..... G10L 19/005
See application file for complete search history.

(56) References Cited

U.S. PATENT DOCUMENTS 6,757,654 B1 6/2004 Westerlund et al.
8,204,743 B2 6/2012 Sung et al.
(Continued)

FOREIGN PATENT DOCUMENTS

KR 10-2011-0002070 A 1/2011
WO 2014/046526 A1 3/2014

OTHER PUBLICATIONS

3GPP TS 26.290 V1.0.0, "3rd Generation Partnership Project; Technical Specification, Group Service and System Aspects; Audio Codec Processing Functions; Extended AMR Wideband Codec; Transcoding Functions (Release 6)", Jun. 2004, total 73 pages.
(Continued)

*Primary Examiner* — Douglas Godbold
(74) *Attorney, Agent, or Firm* — Sughrue Mion, PLLC

(57) ABSTRACT

A method and an apparatus for packet loss concealment, and a decoding method and an apparatus employing same are disclosed. A method for time domain packet loss concealment includes checking whether a current frame is either an erased frame or a good frame after the erased frame, when the current frame is either the erased frame or the good frame after the erased frame, obtaining signal characteristics, selecting one of a phase matching tool and a smoothing tool based on a plurality of parameters including the signal characteristics, and performing a packet loss concealment processing on the current frame based on the selected tool.

8 Claims, 27 Drawing Sheets

(51) Int. Cl.

| | |
|---|---|
| ***G10L 19/022*** | (2013.01) |
| ***G10L 19/02*** | (2013.01) |
| ***G10L 25/21*** | (2013.01) |

(56) References Cited

U.S. PATENT DOCUMENTS

| | | | | |
|---|---|---|---|---|
| 8,457,115 | B2 | 6/2013 | Zhan et al. | |
| 2010/0312553 | A1* | 12/2010 | Fang | G10L 19/005 704/226 |
| 2011/0208517 | A1* | 8/2011 | Zopf | G10L 19/005 704/211 |
| 2013/0304464 | A1* | 11/2013 | Wang | G10L 25/78 704/233 |
| 2014/0142957 | A1 | 5/2014 | Sung et al. | |
| 2015/0142452 | A1* | 5/2015 | Sung | G10L 19/005 704/500 |
| 2016/0148618 | A1* | 5/2016 | Huang | G10L 19/0212 381/2 |

OTHER PUBLICATIONS

ETSI TS 126 091 V10.0.0, "Digital cellular telecommunications system (Phase 2+); Universal Mobile Telecommunications System (UMTS); LTE; Mandatory Speech Codec speech processing functions; Adaptive Multi-Rate (AMR) speech codec; Error concealment of lost frames", (3GPP TS 26.091 version 10.0.0 Release 10), Apr. 2011, total 16 pages.

International Search Report (PCT/ISA/210) dated Mar. 18, 2016 issued by the International Searching Authority in counterpart International Application No. PCT/IB2015/001782.

Written Opinion (PCT/ISA/237) dated Mar. 18, 2016 issued by the International Searching Authority in counterpart International Application No. PCT/IB2015/001782.

Communication dated Nov. 28, 2017, issued by the European Patent Office in counterpart European Patent Application No. 15827783.0.

* cited by examiner

METHOD AND APPARATUS FOR PACKET LOSS CONCEALMENT, AND DECODING METHOD AND APPARATUS EMPLOYING SAME

TECHNICAL FIELD

Exemplary Embodiments relate to packet loss concealment, and more particularly, to a packet loss concealment method and apparatus and an audio decoding method and apparatus capable of minimizing deterioration of reconstructed sound quality when an error occurs in partial frames of an audio signal.

BACKGROUND ART

When an encoded audio signal is transmitted over a wired/wireless network, if partial packets are damaged or distorted due to a transmission error, an erasure may occur in partial frames of a decoded audio signal. If the erasure is not properly corrected, sound quality of the decoded audio signal may be degraded in a duration including a frame in which the error has occurred and an adjacent frame.

Regarding audio signal encoding, it is known that a method of performing time-frequency transform processing on a specific signal and then performing a compression process in a frequency domain provides good reconstructed sound quality. In the time-frequency transform processing, a modified discrete cosine transform (MDCT) is widely used. In this case, for audio signal decoding, the frequency domain signal is transformed to a time domain signal using inverse MDCT (IMDCT), and overlap and add (OLA) processing may be performed for the time domain signal. In the OLA processing, if an error occurs in a current frame, a next frame may also be influenced. In particular, a final time domain signal is generated by adding an aliasing component between a previous frame and a subsequent frame to an overlapping part in the time domain signal, and if an error occurs, an accurate aliasing component does not exist, and thus, noise may occur, thereby resulting in considerable deterioration of reconstructed sound quality.

When an audio signal is encoded and decoded using the time-frequency transform processing, in a regression analysis method for obtaining a parameter of an erasure frame by regression-analyzing a parameter of a previous good frame (PGF) from among methods for concealing an erased frame, concealment is possible by somewhat considering original energy for the erased frame, but an error concealment efficiency may be degraded in a portion where a signal is gradually increasing or is severely fluctuated. In addition, the regression analysis method tends to cause an increase in complexity when the number of types of parameters to be applied increases. In a repetition method for restoring a signal in an erased frame by repeatedly reproducing a PGF of the erased frame, it may be difficult to minimize deterioration of reconstructed sound quality due to a characteristic of the OLA processing. An interpolation method for predicting a parameter of an erased frame by interpolating parameters of a PGF and a next good frame (NGF) needs an additional delay of one frame, and thus, it is not proper to employ the interpolation method in a communication codec sensitive to a delay.

Thus, when an audio signal is encoded and decoded using the time-frequency transform processing, there is a need of a method for concealing an erased frame without an additional time delay or an excessive increase in complexity to minimize deterioration of reconstructed sound quality due to packet losses.

DETAILED DESCRIPTION OF THE INVENTION

Technical Problem

Exemplary Embodiments provide a packet loss concealment method and apparatus for more exactly concealing an erased frame adaptively to signal characteristics in a frequency domain or a time domain, with low complexity without an additional time delay.

Exemplary Embodiments also provide an audio decoding method and apparatus for minimizing deterioration of reconstructed sound quality due to packet losses, by more exactly reconstructing an erased frame adaptively to signal characteristics in a frequency domain or a time domain, with low complexity without an additional time delay.

Exemplary Embodiments also provide a non-transitory computer-readable storage medium having stored therein program instructions, which when executed by a computer, perform the packet loss concealment method or the audio decoding method.

Technical Solution

According to an aspect of an exemplary embodiment, there is provided a method for time domain packet loss concealment, the method including checking whether a current frame is either an erased frame or a good frame after the erased frame, when the current frame is either the erased frame or the good frame after the erased frame, obtaining signal characteristics, selecting one of a phase matching tool and a smoothing tool based on a plurality of parameters including the signal characteristics, and performing a packet loss concealment processing on the current frame based on the selected tool.

According to another aspect of an exemplary embodiment, there is provided an apparatus for time domain packet loss concealment, the apparatus including a processor configured to check whether a current frame is either an erased frame or a good frame after the erased frame, when the current frame is either the erased frame or the good frame after the erased frame, obtain signal characteristics, select one of a phase matching tool and a smoothing tool based on a plurality of parameters including the signal characteristics, and perform a packet loss concealment processing on the current frame based on the selected tool.

According to an aspect of an exemplary embodiment, there is provided an audio decoding method including performing packet loss concealment processing in a frequency domain when a current frame is an erased frame, decoding spectral coefficients when the current frame is a good frame, performing time-frequency inverse transform processing on the current frame that is an erased frame after time-frequency inverse transforming or a good frame, checking whether a current frame is either an erased frame or a good frame after the erased frame, when the current frame is either the erased frame or the good frame after the erased frame, obtaining signal characteristics, selecting one of a phase matching tool and a smoothing tool based on a plurality of parameters including the signal characteristics, and performing a packet loss concealment processing on the current frame based on the selected tool.

According to an aspect of an exemplary embodiment, there is provided an audio decoding apparatus including a processor configured to perform packet loss concealment processing in a frequency domain when a current frame is an erased frame, decode spectral coefficients when the current frame is a good frame, perform time-frequency inverse transform processing on the current frame that is an erased frame after time-frequency inverse transforming or a good frame, check whether a current frame is either an erased frame or a good frame after the erased frame, when the current frame is either the erased frame or the good frame after the erased frame, obtain signal characteristics, select one of a phase matching tool and a smoothing tool based on a plurality of parameters including the signal characteristics, and perform a packet loss concealment processing on the current frame based on the selected tool.

Advantageous Effects of the Invention

According to exemplary embodiments, a rapid signal fluctuation in a frequency domain may be smoothed and an erased frame may be more accurately reconstructed adaptively to signal characteristics such as transient characteristic and a burst erasure period, with low complexity without an additional delay.

In addition, by performing smoothing processing in an optimal method according to signal characteristics in a time domain, a rapid signal fluctuation due to an erased frame in the decoded signal may be smoothed with low complexity without an additional delay.

In particular, an erased frame that is a transient frame or an erased frame constituting a burst error may be more accurately reconstructed, and as a result, influence affected to a good frame next to the erased frame may be minimized.

In addition, by copying a predetermined sized segment obtained based on phase matching from a plurality of previous frames stored in a buffer to a current frame that is an erased frame and performing smoothing processing between adjacent frames, the improvement of reconstructed sound quality for a low frequency band may be additionally expected.

DESCRIPTION OF THE DRAWINGS

The above and other features and advantages will become more apparent by describing in detail exemplary embodiments thereof with reference to the attached drawings in which.

MODE OF THE INVENTION

The present inventive concept may allow various kinds of change or modification and various changes in form, and specific exemplary embodiments will be illustrated in drawings and described in detail in the specification. However, it should be understood that the specific exemplary embodiments do not limit the present inventive concept to a specific disclosing form but include every modified, equivalent, or replaced one within the spirit and technical scope of the present inventive concept. In the following description, well-known functions or constructions are not described in detail since they would obscure the invention with unnecessary detail.

Although terms, such as 'first' and 'second', can be used to describe various elements, the elements cannot be limited by the terms. The terms can be used to classify a certain element from another element.

The terminology used in the application is used only to describe specific exemplary embodiments and does not have any intention to limit the present inventive concept. Although general terms as currently widely used as possible are selected as the terms used in the present inventive concept while taking functions in the present inventive concept into account, they may vary according to an intention of those of ordinary skill in the art, judicial precedents, or the appearance of new technology. In addition, in specific cases, terms intentionally selected by the applicant may be used, and in this case, the meaning of the terms will be disclosed in corresponding description of the invention. Accordingly, the terms used in the present inventive concept should be defined not by simple names of the terms but by the meaning of the terms and the content over the present inventive concept.

An expression in the singular includes an expression in the plural unless they are clearly different from each other in a context. In the application, it should be understood that terms, such as 'include' and 'have', are used to indicate the existence of implemented feature, number, step, operation, element, part, or a combination of them without excluding in advance the possibility of existence or addition of one or more other features, numbers, steps, operations, elements, parts, or combinations of them.

Exemplary embodiments will now be described in detail with reference to the accompanying drawings.

Figure 1:
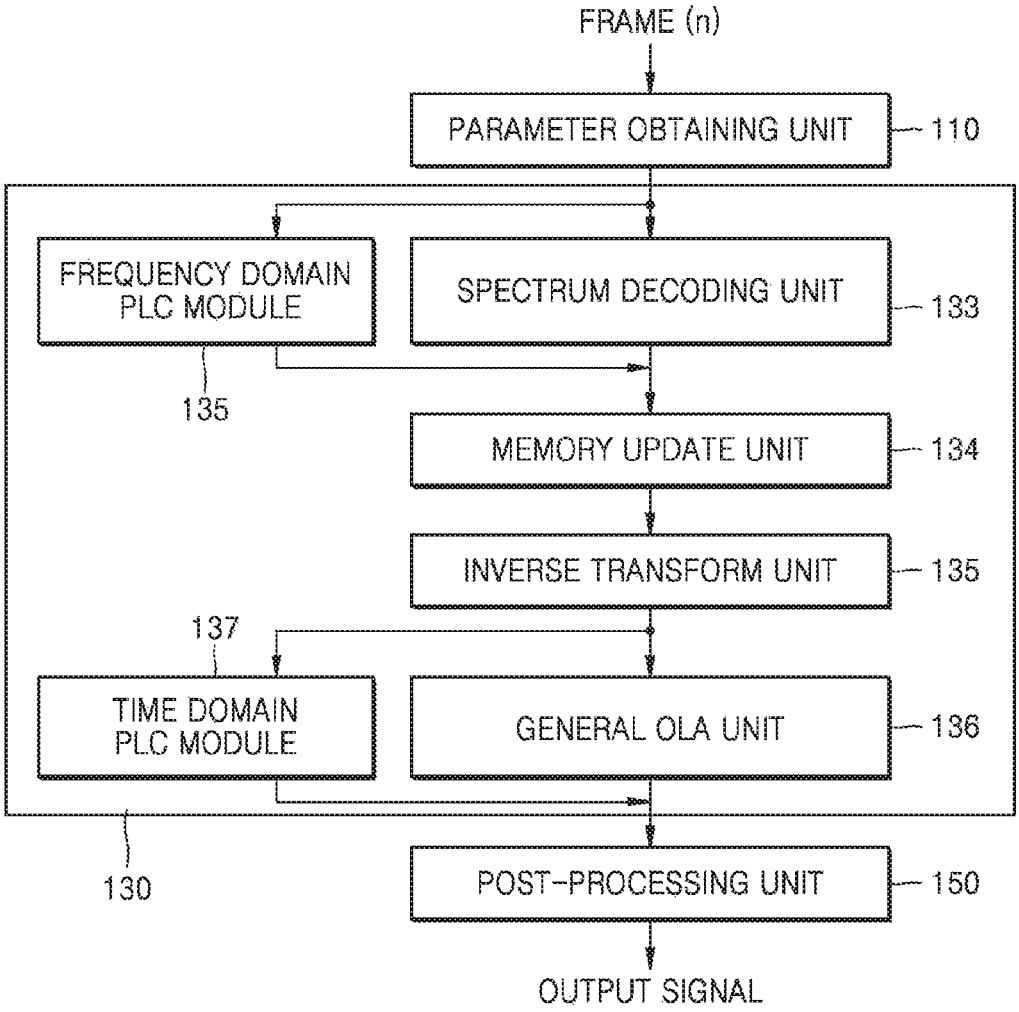
FIG. 1 is a block diagram of a frequency domain audio decoding apparatus according to an exemplary embodiment.

FIG. 1 is a block diagram of a frequency domain audio decoding apparatus according to an exemplary embodiment.

The frequency domain audio decoding apparatus shown in FIG. 1 may include a parameter obtaining unit 110, a frequency domain decoding unit 130 and a post-processing unit 150. The frequency domain decoding unit 130 may include a frequency domain packet loss concealment (PLC) module 132, a spectrum decoding unit 133, a memory update unit 134, an inverse transform unit 135, a general overlap and add (OLA) unit 136, and a time domain PLC module 137. The components except for a memory (not shown) embedded in the memory update unit 134 may be integrated in at least one module and may be implemented as at least one processor (not shown). Functions of the memory update unit 134 may be distributed to and included in the frequency domain PLC module 132 and the spectrum decoding unit 133.

Referring to FIG. 1, a parameter obtaining unit 110 may decode parameters from a received bitstream and check from the decoded parameters whether an error has occurred in frame units. Information provided by the parameter obtaining unit 110 may include an error flag indicating whether a current frame is an erased frame and the number of erased frames which have continuously occurred until the present. If it is determined that an erasure has occurred in the current frame, an error flag such as a bad frame indicator (BFI) may be set to 1, indicating that no information exists for the erased frame.

The frequency domain PLC module 132 may have a frequency domain packet loss concealment algorithm therein and operate when the error flag BFI provided by the parameter obtaining unit 110 is 1, and a decoding mode of a previous frame is the frequency domain mode. According to an exemplary embodiment, the frequency domain PLC module 132 may generate a spectral coefficient of the erased frame by repeating a synthesized spectral coefficient of a PGF stored in a memory (not shown). In this case, the repeating process may be performed by considering a frame type of the previous frame and the number of erased frames which have occurred until the present. For convenience of description, when the number of erased frames which have continuously occurred is two or more, this occurrence corresponds to a burst erasure.

According to an exemplary embodiment, when the current frame is an erased frame forming a burst erasure and the previous frame is not a transient frame, the frequency domain PLC module 132 may forcibly down-scale a decoded spectral coefficient of a PGF by a fixed value of 3 dB from, for example, a fifth erased frame. That is, if the current frame corresponds to a fifth erased frame from among erased frames which have continuously occurred, the frequency domain PLC module 132 may generate a spectral coefficient by decreasing energy of the decoded spectral coefficient of the PGF and repeating the energy decreased spectral coefficient for the fifth erased frame.

According to another exemplary embodiment, when the current frame is an erased frame forming a burst erasure and the previous frame is a transient frame, the frequency domain PLC module 132 may forcibly down-scale a decoded spectral coefficient of a PGF by a fixed value of 3 dB from, for example, a second erased frame. That is, if the current frame corresponds to a second erased frame from among erased frames which have continuously occurred, the frequency domain PLC module 132 may generate a spectral coefficient by decreasing energy of the decoded spectral coefficient of the PGF and repeating the energy decreased spectral coefficient for the second erased frame.

According to another exemplary embodiment, when the current frame is an erased frame forming a burst erasure, the frequency domain PLC module 132 may decrease modulation noise generated due to the repetition of a spectral coefficient for each frame by randomly changing a sign of a spectral coefficient generated for the erased frame. An erased frame to which a random sign starts to be applied in an erased frame group forming a burst erasure may vary according to a signal characteristic. According to an exemplary embodiment, a position of an erased frame to which a random sign starts to be applied may be differently set according to whether the signal characteristic indicates that the current frame is transient, or a position of an erased frame from which a random sign starts to be applied may be differently set for a stationary signal from among signals that are not transient. For example, when it is determined that a harmonic component exists in an input signal, the input signal may be determined as a stationary signal of which signal fluctuation is not severe, and a packet loss concealment algorithm corresponding to the stationary signal may be performed. Commonly, information transmitted from an encoder may be used for harmonic information of an input signal. When low complexity is not necessary, harmonic information may be obtained using a signal synthesized by a decoder.

According to another exemplary embodiment, the frequency domain PLC module 132 may apply the down-scaling or the random sign for not only erased frames forming a burst erasure but also in a case where every other frame is an erased frame. That is, when a current frame is an erased frame, a one-frame previous frame is a good frame, and a two-frame previous frame is an erased frame, the down-scaling or the random sign may be applied.

The spectrum decoding unit 133 may operate when the error flag BFI provided by the parameter obtaining unit 110 is 0, i.e., when a current frame is a good frame. The spectrum decoding unit 133 may synthesize spectral coefficients by performing spectrum decoding using the parameters decoded by the parameter obtaining unit 110.

The memory update unit 134 may update, for a next frame, the synthesized spectral coefficients, information obtained using the decoded parameters, the number of erased frames which have continuously occurred until the present, information on a signal characteristic or frame type of each frame, and the like with respect to the current frame that is a good frame. The signal characteristic may include a transient characteristic or a stationary characteristic, and the frame type may include a transient frame, a stationary frame, or a harmonic frame.

The inverse transform unit 135 may generate a time domain signal by performing a time-frequency inverse transform on the synthesized spectral coefficients. The inverse transform unit 135 may provide the time domain signal of the current frame to one of the general OLA unit 136 and the time domain PLC module 137 based on an error flag of the current frame and an error flag of the previous frame.

The general OLA unit 136 may operate when both the current frame and the previous frame are good frames. The general OLA unit 136 may perform general OLA processing by using a time domain signal of the previous frame, generate a final time domain signal of the current frame as a result of the general OLA processing, and provide the final time domain signal to a post-processing unit 150.

The time domain PLC module 137 may operate when the current frame is an erased frame or when the current frame is a good frame, the previous frame is an erased frame, and a decoding mode of the latest PGF is the frequency domain mode. That is, when the current frame is an erased frame, packet loss concealment processing may be performed by the frequency domain PLC module 132 and the time domain PLC module 137, and when the previous frame is an erased frame and the current frame is a good frame, the packet loss concealment processing may be performed by the time domain PLC module 137.

The post-processing unit 150 may perform filtering, upsampling, or the like for sound quality improvement with respect to the time domain signal provided from the frequency domain decoding unit 130, but is not limited thereto. The post-processing unit 150 provides a reconstructed audio signal as an output signal.

Figure 2:
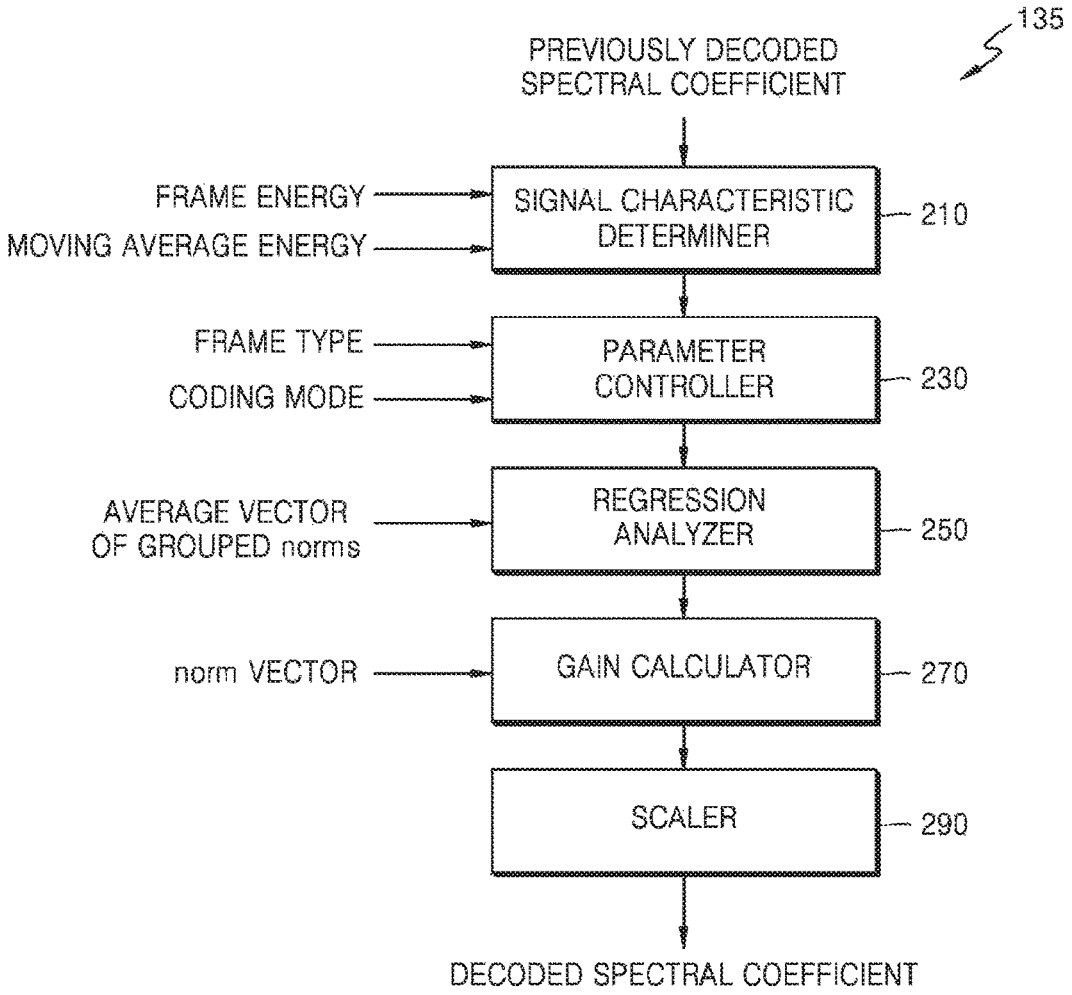
FIG. 2 is a block diagram of a frequency domain packet loss concealment apparatus according to an exemplary embodiment.

FIG. 2 is a block diagram of a frame domain packet loss concealment apparatus according to an exemplary embodiment. The apparatus of FIG. 2 may be applied to a case where a BFI flag is 1 and a decoding mode of a previous frame is a frequency domain mode. The apparatus of FIG. 2 may achieve an adaptive fade-out and may be applied to burst erasure.

The apparatus shown in FIG. 2 may include a signal characteristic determiner 210, a parameter controller 230, a regression analyzer 250, a gain calculator 270, and a scaler 290. The components may be integrated in at least one module and be implemented as at least one processor (not shown).

Referring to FIG. 2, the signal characteristic determiner 210 may determine characteristics of a signal by using a decoded signal and by means of characteristics of the decoded signal, a frame may be classified into a transient frame, a normal frame, a stationary frame, and the like. A method of determining a transient frame will now be described below. According to an exemplary embodiment, whether a current frame is a transient frame or a stationary frame may be determined using a frame type is_transient which is transmitted from an encoder and energy difference energy_diff. To do this, moving average energy $E_{MA}$ and energy difference energy_diff obtained for a good frame may be used.

A method of obtaining $E_{MA}$ and energy_diff will now be described.

If it is assumed that an average of energy or norm values of a current frame is $E_{curr}$, $E_{MA}$ may be obtained by $E_{MA}=E_{MA_old}*0.8+E_{curr}*0.2$. In this case, an initial value of $E_{MA}$ may be set to, for example, 100. $E_{MA_old}$ represents moving average energy of a previous frame and $E_{MA}$ may be updated to $E_{MA_old}$ for a next frame.

Next, energy_diff may be obtained by normalizing a difference between $E_{MA}$ and $E_{curr}$ and may be represented by an absolute value of the normalized energy difference.

The signal characteristic determiner 210 may determine the current frame not to be transient when energy_diff is smaller than a predetermined threshold and the frame type is_transient is 0, i.e. is not a transient frame. The signal characteristic determiner 210 may determine the current frame to be transient when energy_diff is equal to or greater than a predetermined threshold and the frame type is_transient is 1, i.e. is a transient frame. energy_diff of 1.0 indicates that $E_{curr}$ is double $E_{MA}$ and may indicate that a change in energy of the current frame is very large as compared with the previous frame.

The parameter controller 230 may control a parameter for packet loss concealment using the signal characteristics determined by the signal characteristic determiner 210 and a frame type and an encoding mode included in information transmitted from an encoder.

The number of previous good frames used for regression analysis may be exemplified as a parameter a parameter controlled for packet loss concealment. To do this, whether a current frame is a transient frame may be determined, by using the information transmitted from the encoder or transient information obtained by the signal characteristic determiner 210. When the two kinds of information are simultaneously used, the following conditions may be used: That is, if is_transient that is transient information transmitted from the encoder is 1, or if energy_diff that is information obtained by a decoder is equal to or greater than the predetermined threshold ED_THRES, e.g., 1.0, this indicates that the current frame is a transient frame of which a change in energy is severe, and accordingly, the number num_pgf of PGFs to be used for a regression analysis may be decreased. Otherwise, it is determined that the current frame is not a transient frame, and num_pgf may be increased. This may be represented as the following pseudo codes.

```
if(energy_diff < ED_THRES && is_transient == 0 ) {
        num_pgf = 4;
    }
    else{
        num_pgf = 2;
    }
```

In the above context, ED_THRES denotes a threshold and may be set to, for example, 1.0.

Another example of the parameter for packet loss concealment may be a scaling method of a burst error duration. The same energy_diff value may be used in one burst error duration. If it is determined that the current frame that is an erased frame is not transient, when a burst erasure occurs, frames starting from, for example, a fifth frame, may be forcibly scaled as a fixed value of 3 dB regardless of a regression analysis of a decoded spectral coefficient of the previous frame. Otherwise, if it is determined that the current frame that is an erased frame is transient, when a burst erasure occurs, frames starting from, for example, a second frame, may be forcibly scaled as a fixed value of 3 dB regardless of the regression analysis of the decoded spectral coefficient of the previous frame. Another example of the parameter for packet loss concealment may be an applying method of adaptive muting and a random sign, which will be described below with reference to the scaler 290.

The regression analyzer 250 may perform a regression analysis by using a stored parameter of a previous frame. A condition of an erased frame on which the regression analysis is performed may be defined in advance when a decoder is designed. In a case where regression analysis is performed when a burst erasure has occurred, when nbLostCmpt indicates the number of contiguous erased frames is two, from the second contiguous erased frame, the regression analysis is performed. In this case, for the first erased frame, a spectral coefficient obtained from a previous frame may be simply repeated, or a spectral coefficient may be scaled by a determined value.

```
if (nbLostCmpt==2){
regression_anaysis();
}
```

In the frequency domain, a problem similar to continuous erasures may occur even though the continuous erasures have not occurred as a result of transforming an overlapped signal in the time domain. For example, if erasure occurs by skipping one frame, in other words, if erasures occur in an order of an erased frame, a good frame, and an erased frame, when a transform window is formed by an overlapping of 50%, sound quality is not largely different from a case where erasures have occurred in an order of an erased frame, an erased frame, and an erased frame, regardless of the presence of a good frame in the middle. Even though an nth frame is a good frame, if (n−1)th and (n+1)th frames are erased frames, a totally different signal is generated in an overlapping process. Thus, when erasures occur in an order of an erased frame, a good frame, and an erased frame, although nbLostCmpt of a third frame in which a second erasure occurs is 1, nbLostCmpt is forcibly increased by 1. As a result, nbLostCmpt is 2, and it is determined that a burst erasure has occurred, and thus the regression analysis may be used.

```
if((prev_old_bfi==1) && (nbLostCmpt ==1))
{
    st -> nbLostCmpt ++;
}
if(bfi_cnt==2){
regression_anaysis();
}
```

In the above context, prev_old_bfi denotes frame error information of a second previous frame. This process may be applicable when a current frame is an error frame.

The regression analyzer 250 may form each group by grouping two or more bands, derive a representative value of each group, and apply the regression analysis to the representative value, for low complexity. Examples of the representative value may be a mean value, an intermediate value, and a maximum value, but the representative value is not limited thereto. According to an exemplary embodiment, an average vector of grouped norms that is an average norm value of bands included in each group may be used as the representative value. The number of PGFs used for regression analysis may be 2 or 4. The number of rows of a matrix used for regression analysis may be set to for example 2.

As a result of the regression analysis by the regression analyzer 250, an average norm value of each group may be predicted for an erased frame. That is, the same norm value may be predicted for each band belonging to one group in the erased frame. In detail, the regression analyzer 250 may calculate values a and b from a linear regression analysis equation through the regression analysis and predict an average norm value for each group by using the calculated values a and b. The calculated value a may be adjusted within a predetermined range. In an EVS codec, the predetermined range may be limited to a negative value. In the following pseudo-code, norm_values is an average norm value of each group in the previous good frame and norm_p is a predicted average norm value of each group.

```
if( a > 0 ){
a = 0;
norm_p[i] = norm_values[0];
}
else {
norm_p[i] = (b+a*(nbLostCmpt−1+num_pgf);
}
```

With this modified value of a, the average norm value of each group may be predicted.

The gain calculator 270 may obtain a gain between an average norm value of each group that is predicted for the erased frame and an average norm value of each group in a previous good frame. When the predicted norm is larger than zero and the norm of the previous frame is non-zero, gain calculation may be performed. When the predicted norm is smaller than zero or the norm of the previous frame is zero, the gain may be scaled down by 3 dB from an initial value, for example, 1.0. The calculated gain may be adjusted to a predetermined range. In EVS codec, the maximum value of the gain may be set to 1.0.

The scaler 290 may apply gain scaling to the previous good frame to predict spectral coefficients of the erased frame. The scaler 290 may also apply adaptive muting to the erased frame and a random sign to predicted spectral coefficients according to characteristics of an input signal.

First, the input signal may be identified as a transient signal and a non-transient signal. A stationary signal may be separately identified from the non-transient signal and processed in another method. For example, if it is determined that the input signal has a lot of harmonic components, the input signal may be determined as a stationary signal of which a change in the signal is not large, and a packet loss concealment algorithm corresponding to the stationary signal may be performed. In general, harmonic information of the input signal may be obtained from the information transmitted from the encoder. When low complexity is not necessary, the harmonic information of the input signal may be obtained using a signal synthesized by the decoder.

When the input signal is largely classified into a transient signal, a stationary signal, and a residual signal, the adaptive muting and the random sign may be applied as described below. In the context below, a number indicated by mute_start indicates that muting forcibly starts if bfi_cnt is equal to or greater than mute_start when a burst erasure occurs. In addition, random_start related to the random sign may be analyzed in the same way.

```
if((old_clas == HARMONIC) && (is_transient==0)) /* Stationary
signal */
{
    mute_start = 4;
    random_start = 3;
```

-continued

```
}
else if((Energy_diff<ED_THRES) && (is_transient==0)) /* Residual
signal */
{
    mute_start = 3;
    random_start = 2;
}
else /* Transient signal */
{
    mute_start = 2;
    random_start = 2;
}
```

According to a method of applying the adaptive muting, spectral coefficients are forcibly down-scaled by a fixed value. For example, if bfi_cnt of a current frame is 4, and the current frame is a stationary frame, spectral coefficients of the current frame may be down-scaled by 3 dB.

In addition, a sign of spectral coefficients is randomly modified to reduce modulation noise generated due to repetition of spectral coefficients in every frame. Various well-known methods may be used as a method of applying the random sign.

According to an exemplary embodiment, the random sign may be applied to all spectral coefficients of a frame. According to another exemplary embodiment, a frequency band to which the random sign starts to be applied may be defined in advance, and the random sign may be applied to frequency bands equal to or higher than the defined frequency band, because it may be better to use a sign of a spectral coefficient that is identical to that of a previous frame in a very low frequency band, e.g., 200 Hz or less, or a first band since a waveform or energy may be largely changed due to a change in a sign in the very low frequency band.

Accordingly, a sharp change in a signal may be smoothed, and an error frame may be accurately restored to be adaptive to characteristics of the signal, in particular, a transient characteristic, and a burst erasure duration without an additional delay at low complexity in the frequency domain.

Figure 3:
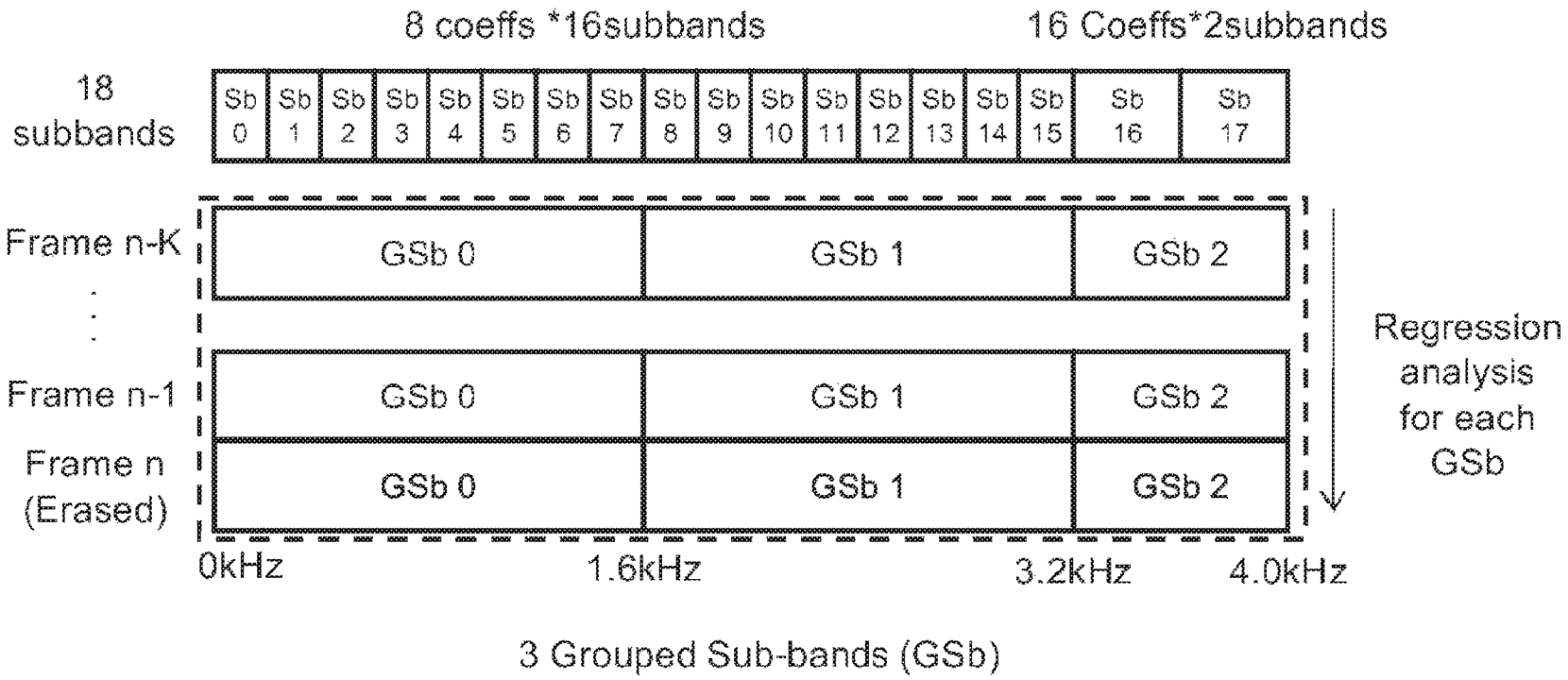
FIG. 3 illustrates a structure of sub-bands grouped to apply the regression analysis, according to an exemplary embodiment.

FIG. 3 illustrates a structure of sub-bands grouped to apply the regression analysis, according to an exemplary embodiment. The regression analysis may be applied to a narrowband signal, which is supported up to e.g. 4.0 KHz.

Referring to FIG. 3, for a first region, an average norm value is obtained by grouping 8 sub-bands as one group, and a grouped average norm value of an erased frame is predicted using a grouped average norm value of a previous frame. Grouped average norm values obtained from grouped sub-bands form a vector, which is referred to as an average vector of grouped norms. By using the average vector of grouped norms, a and b in Equation 1 may be obtained. K grouped average norm values of each grouped sub-band (GSb) are used for the regression analysis.

Figure 4:
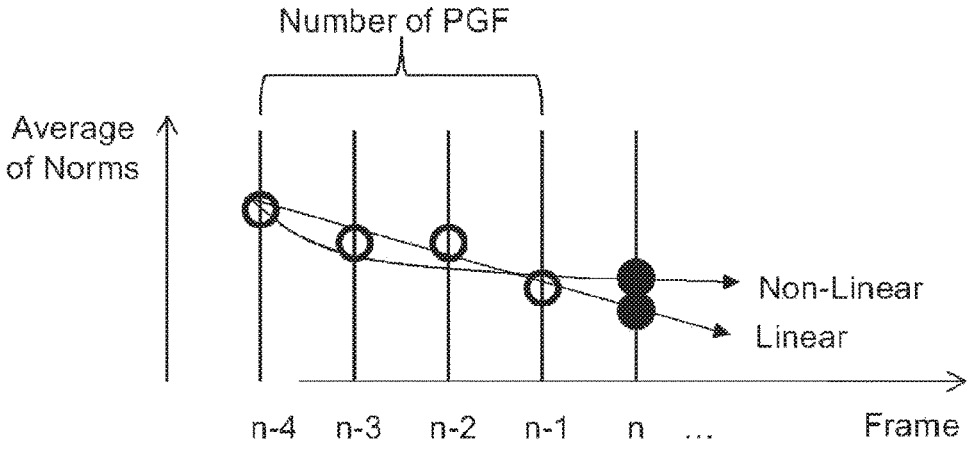
FIG. 4 illustrates the concepts of a linear regression analysis and a non-linear regression analysis which are applied to an exemplary embodiment.

FIG. 4 illustrates the concepts of a linear regression analysis and a non-linear regression analysis. The linear regression analysis may be applied to a packet loss algorithm according to an exemplary embodiment. In this case, 'average of norms' indicates an average norm value obtained by grouping several bands and is a target to which a regression analysis is applied. A linear regression analysis is performed when a quantized value is used for an average norm value of a previous frame. 'Number of PGF' indicating the number of PGFs used for a regression analysis may be variably set.

An example of the linear regression analysis may be represented by Equation 2.

$$y = ax + b \tag{2}$$

$$\begin{bmatrix} m & \sum x_k \\ \sum x_k & \sum x_k^2 \end{bmatrix} \begin{bmatrix} b \\ a \end{bmatrix} = \begin{bmatrix} \sum y_k \\ \sum x_k y_k \end{bmatrix}$$

As in Equation 2, when a linear equation is used, the upcoming transition y may be predicted by obtaining a and b. In Equation 2, a and b may be obtained by an inverse matrix. A simple method of obtaining an inverse matrix may use Gauss-Jordan Elimination.

Figure 5:
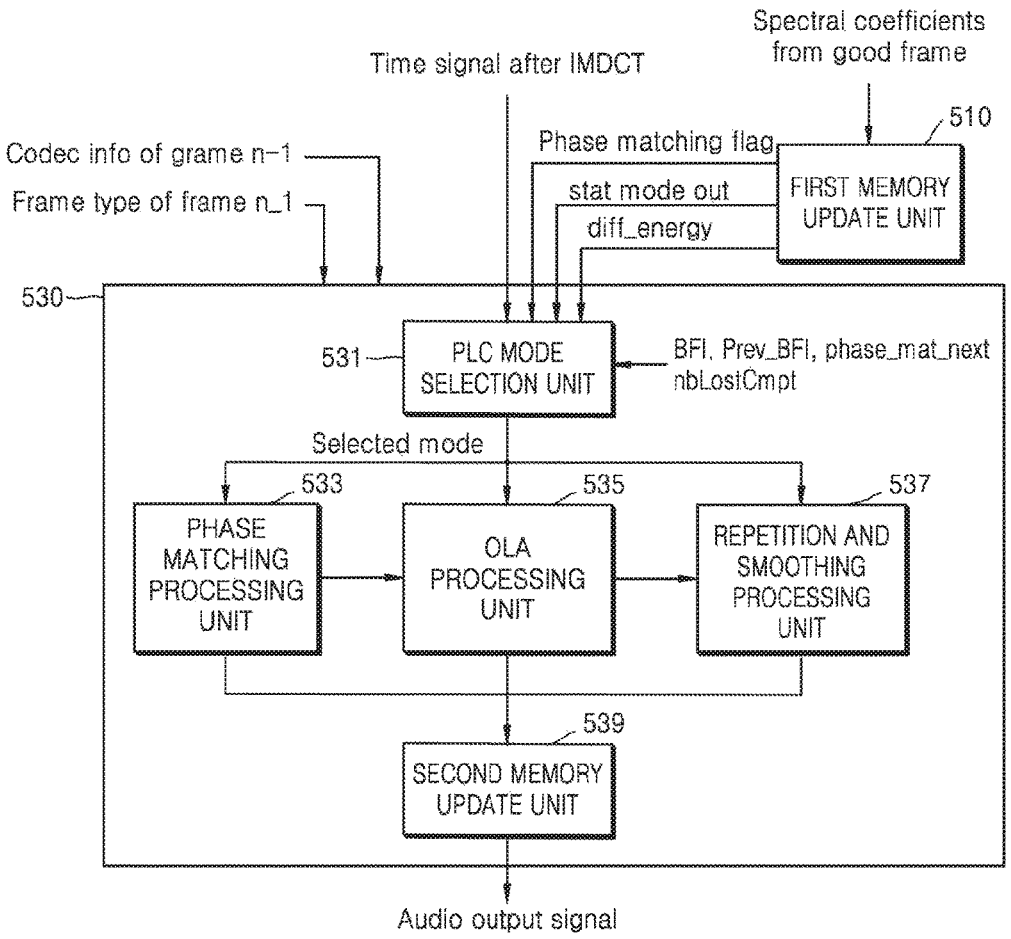
FIG. 5 is a block diagram of a time domain packet loss concealment apparatus according to an exemplary embodiment.

FIG. 5 is a block diagram of a time domain packet loss concealment apparatus according to an exemplary embodiment. The apparatus of FIG. 5 may be used to achieve an additional quality enhancement taking into account the input signal characteristics and may include two concealment tools, consisting of a phase matching tool and a repetition and smoothing tool and a general OLA module. With the two concealment tools, an appropriate concealment method may be selected by checking the stationarity of the input signal.

The apparatus 500 shown in FIG. 5 may include a PLC mode selection unit 531, a phase matcing processing unit 533, an OLA processing unit 535, a repetition and smoothing processing unit 537 and a second memory update unit 539. The function of the second memory update unit 539 may be included into each processing unit 533, 535 and 537. Here, the first memory update unit 510 may correspond to the memory update unit 134 of FIG. 1.

Referring to FIG. 5, the first memory update unit 510 may provide a variety of parameters for PLC mode selection. The variety of parameters may include phase_matching_flag, stat_mode_out and diff_energy, etc.

The PLC mode selection unit 531 may receive a flag BFI of a current frame, a flag Prev_BFI of a previous frame, the number nbLostCmpt of contiguous erased frame and the parameters provided from the first memory update unit 510, and select a PLC mode. For each flag, 1 represents an erased frame and 0 represents a good frame. When the number of contiguous erased frame is equal to or greater than e.g. 2, it may be determined that a durst erasure is formed. According to a result of selection in the PLC mode selection unit 531, a time domain signal of the current frame may be provided to one of processing units 533, 535 and 537.

Table 1 summarizes the PLC modes. There are two tools for the time-domain PLC.

TABLE 1

| Name of tools | Single erasure frame | Burst erasure frame | Next good frame | Next good frame after burst erasures |
|---|---|---|---|---|
| Phase matching | Phase matching for erased frame | Phase matching for burst erasures | Phase matching for next good frame | Phase matching for next good frame |

TABLE 1-continued

| Name of tools | Single erasure frame | Burst erasure frame | Next good frame | Next good frame after burst erasures |
|---|---|---|---|---|
| Repetition & Smoothing | Repetition & smoothing for erased frame | Repetition & smoothing for erased frame | Repetition & smoothing for next good frame | Next good frame after burst erasures |

Table 2 summarizes the PLC mode selection method in the PLC mode selection unit 531.

TABLE 2

| Parameters | Status of Parameters | | | | | | Definitions |
|---|---|---|---|---|---|---|---|
| BFI | 1 | 0 | 1 | 1 | 0 | 0 | Bad frame indicator for the current frame |
| Prev_BFI | — | 1 | 1 | — | 1 | 1 | BFI for the previous frame |
| nbLostCmpt | 1 | — | — | — | — | >1 | The number of contiguous erased frames |
| Phase_mat_flag | 1 | — | — | 0 | 0 | 0 | The flag for the Phase matching process (1: used, 0: not used) |
| Phase_mat_next | — | 1 | 1 | 0 | 0 | 0 | The flag for the Phase matching process for burst erasures or next good frame (1: used, 0: not used) |
| stat_mode_out | — | — | — | (1)* | (1)* | 0 | The flag for Repetition &smoothing process (1: used, 0: not used) |
| diff_energy | — | — | — | (<0.159063)* | (<0.159063)* | ≥0.159063 | Energy difference |
| Selected PLC mode | Phase Matching for erased frame | Phase Matching for next good frame | Phase Matching for burst erasures | Repetition &smoothing for erased frame | Repetition &smoothing for next good frame | Next good frame after burst erasures | |
| Name of tools | Phase matching | | | Repetition and Smoothing | | | |

NOTE:
*The ( ) means "OR" connections.

The pseudo code to select a PLC mode for the phase matching tool may be summarized as follows.

```
if( (nbLostCmpt==1)&&(phase_mat_flag==1)&&(phase_mat_next==0)
) {
    Phase matching for erased frame ();
}
else if((prev_bfi == 1)&&(bfi == 0) &&(phase_mat_next == 1)) {
    Phase matching for next good frame ();
}
```

-continued

```
else if((prev_bfi == 1)&&(bfi == 1) &&(phase_mat_next == 1)) {
    Phase matching for burst erasures ();
}
```

The phase matching flag (phase_mat_flag) may be used to determine at the point of the first memory update unit 510 in the previous good frame whether phase matching erasure concealment processing is used for every good frame when an erasure occurs in a next frame. To this end, energy and spectral coefficients of each sub-band may be used. The energy may be obtained from the norm value, but not limited thereto. More specifically, when a sub-band having the maximum energy in a current frame belongs to a predetermined low frequency band, and the inter-frame energy change is not large, the phase matching flag may be set to 1.

According to an exemplary embodiment, when a sub-band having the maximum energy in the current frame is within the range of 75 Hz to 1000 Hz, a difference between the index of the current frame and the index of a previous frame with respect to a corresponding sub-band is 1 or less, and the current frame is a stationary frame of which an energy change is less than the threshold, and e.g. three past frames stored in the buffer are not transient frames, then phase matching erasure concealment processing will be applied to a next frame to which an erasure has occurred. The pseudo code may be summarized as follows.

```
if ((Min_ind<5) && ( abs(Min_ind − old_Min_ind)< 2) &&
(diff_energy<ED_THRES_90P) && (!bfi) && (!prev_bfi) &&
(!prev_old_bfi) &&
(!is_transient) && (!old_is_transient[1])) {
    if((Min_ind==0) && (Max_ind<3)) {
    phase_mat_flag = 0;
    }
    else {
    phase_mat_flag = 1;
    }
    }
    else {
    phase_mat_flag = 0;
    }
```

The PLC mode selection method for the repetition and smoothing tool and the conventional OLA may be performed by stationarity detection and is explained as follows.

A hysteresis may be introduced in order to prevent a frequent change of the detected result in stationarity detection. The stationarity detection of the erased frame may determine whether the current erased frame is stationary by receiving information including a stationary mode stat_mode_old of the previous frame, an energy difference diff_energy, and the like. Specifically, the stationary mode flag stat_mode_curr of the current frame is set to 1 when the energy difference diff_energy is less than a threshold, e.g. 0.032209.

If it is determined that the current frame is stationary, the hysteresis application may generate a final stationarity parameter, stat_mode_out from the current frame by applying the stationarity mode parameter stat_mode_old of the previous frame to prevent a frequent change in stationarity information of the current frame. That is, when it is determined that a current frame is stationary and a previous frame is a stationary frame, the current frame may be detected as the stationary frame.

The operation of the PLC mode selection may depend on whether the current frame is an erased frame or the next good frame after an erased frame. Referring to Table 2, for an erased frame, a determination may be made whether the input signal is stationary by using various parameters. More specifically, when the previous good frame is stationary and the energy difference is less than the threshold, it is concluded that the input signal is stationary. In this case, the repetition and smoothing processing may be performed. If it is determined that the input signal is not stationary, then the general OLA processing may be performed.

Meanwhile, if the input signal is not stationary, then for the next good frame after an erased frame a determination may be made whether the previous frame is a burst erasure frame by checking whether the number of consecutive erased frames is greater than one. If this is the case, then erasure concealment processing on the next good frame is performed in response to the previous frame that is a burst erasure frame. If it is determined that the input signal is not stationary and the previous frame is a random erasure, then the conventional OLA processing is performed.

If the input signal is stationary, then the erasure concealment processing, i.e. repetition and smoothing processing, on the next good frame may be performed in response to the previous frame that is erased. This repetition and smoothing for next good frame has two types of concealment methods. One is repetition and smoothing method for the next good frame after an erased frame, and the other is repetition and smoothing method for the next good frame after burst erasures.

The pseudo code to select a PLC mode for the Repetition and Smoothing tool and the conventional OLA is as follows.

```
if(BFI == 0 && st->prev_ BFI == 1) {
if((stat_mode_out==1) || (diff_energy<0.032209) ) {
Repetition &smoothing for next good frame ();
}
else if(nbLostCmpt > 1) {
Next good frame after burst erasures ();
}
else {
Conventional OLA ();
}
}
else { /* if(BFI == 1) */
if( (stat_mode_out==1) || (diff_energy<0.032209) ) {
if(Repetition &smoothing for erased frame () ) {
Conventional OLA ();
}
}
else {
Conventional OLA ();
}
}
```

The operation of the phase matching processing unit 533 will be explained with reference to FIGS. 6 to 8.

The operation of the OLA processing unit 535 will be explained with reference to FIGS. 9 and 10.

The operation of the repetition and smoothing processing unit 533 will be explained with reference to FIGS. 11 to 19.

The second memory update unit 539 may update various kinds of information used for the packet loss concealment processing on the current frame and store the information in a memory (not shown) for a next frame.

Figure 6:
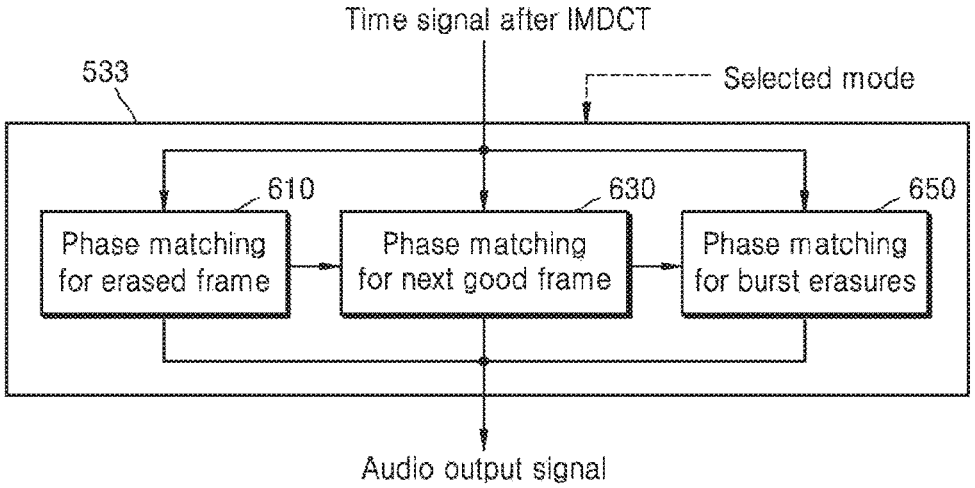
FIG. 6 is a block diagram of a phase matching concealment processing apparatus according to an exemplary embodiment.

FIG. 6 is a block diagram of a phase matching concealment processing apparatus according to an exemplary embodiment.

The apparatus shown in FIG. 6 may include first to third concealment units 610, 630 and 650. The phase matching tool may generate the time domain signal for the current erased frame by copying the phase-matched time domain signal obtained from the previous good frames. Once the phase matching tool is used for an erased frame, the tool shall also be used for the next good frame or subsequent burst erasures. For the next good frame, the phase matching for next good frame tool is used. For subsequent burst erasures, the phase matching tool for burst erasures is used.

Referring to FIG. 6, the first concealment unit 610 may perform phase matching concealment processing on a current erased frame.

The second concealment unit 630 may perform phase matching concealment processing on a next good frame.

That is, when a previous frame is an erased frame and phase matching concealment processing is performed for the previous frame, phase matching concealment processing may be performed on a next good frame.

In the second concealment unit 630, a mean_en_high parameter may be used. The mean_en_high parameter denotes a mean energy of high bands and indicating the similarity of the last good frames. This parameter is calculated by following Equation 2.

$$\text{mean_en_high} = \frac{\sum_{n=k}^{N_{sb}-1}\left(\frac{0.5norm_{k-1}(n)+0.5norm_{k-2}(n)}{norm_k(n)}\right)}{N_{sb}-k} \quad (2)$$

where is start band index of the determined high bands.

If mean_en_high is larger than 2.0 or smaller than 0.5, it indicates that energy change is severe. If energy change is severe, oldout_pha_idx is set to 1. Oldout_pha_idx is used as a switch using the Oldauout memory. The two sets of Oldauout were saved at the both the phase matching for erased frame block and the phase matching for burst erasures block. The 1st Oldauout is generated from a copied signal by a phase matching process, and the 2nd Oldauout is generated by the time domain signal resulting from the IMDCT. If the oldout_pha_idx is set to 1, it indicates that the high band signal is unstable and the 2nd Oldauout will be used for the OLA process in the next good frame. If the oldout_pha_idx is set to 0, it indicates that the high band signal is stable and the 1st Oldauout will be used for OLA process in the next good frame.

The third concealment unit 650 may perform phase matching concealment processing on a burst erasure. That is, when a previous frame is an erased frame and phase matching concealment processing is performed for the previous frame, phase matching concealment processing may be performed on a current frame being a part of the burst erasure.

The third concealment unit 650 does not have maximum correlation search processing and the copying processing, as all information needed for these processing may be reused by phase matching for the erased frame. In the third concealment unit 650, the smoothing may be done between the signal corresponding to the overlap duration of the copied signal and the Oldauout signal stored in the current frame n for overlapping purposes. The Oldauout is actually a copied signal by the phase matching process in the previous frame.

Figure 7:
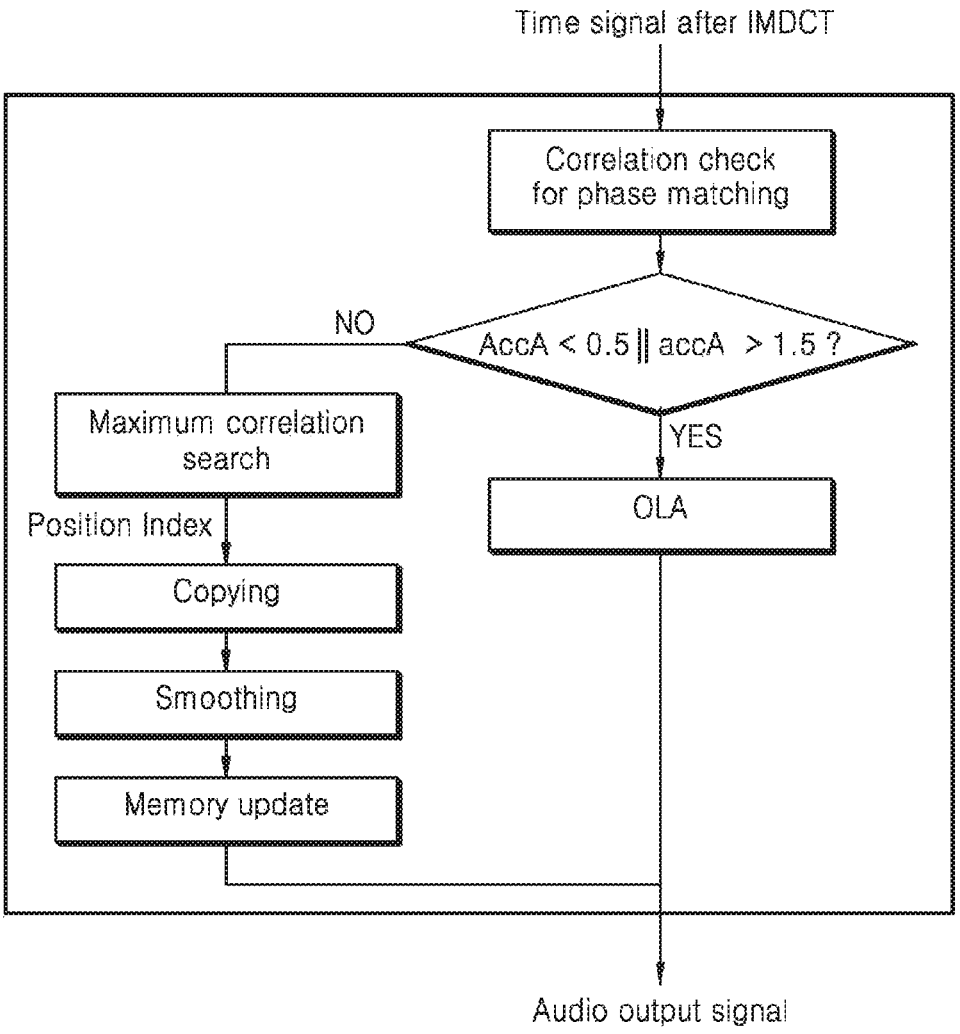
FIG. 7 is a flowchart illustrating an operation of the first concealment unit 610 FIG. 6, according to an exemplary embodiment.

FIG. 7 is a flowchart illustrating an operation of the first concealment unit 610 FIG. 6, according to an exemplary embodiment.

In order to use the phase matching tool, the phase_mat_flag shall be set to 1. That is, when a previous good frame has a maximum energy in a predetermined low frequency band and energy change is smaller than a threshold, phase matching concealment processing may be performed on a current frame being a random erased frame. Even though this condition is satisfied, a correlation scale accA is obtained, and either phase matching erasure concealment processing or general OLA processing may be selected. The selection depends on whether the correlation scale accA is within a predetermined range. That is, phase matching packet loss concealment processing may be conditionally performed depending on whether a correlation between segments exists in a search range and a cross-correlation between a search segment and the segments exists in the search range.

The correlation scale is given by Equation 3.

$$accA = \min\left(\frac{R_{xy}[d]}{R_{yy}[d]}\right),\ d = 0, \ldots, D \quad (3)$$

In Equation 3, d denotes the number of segments existing in the search range, Rxy denotes a cross-correlation used to search for the matching segment having the same length as the search segment (x signal) with respect to the past good frames (y signal) stored in the buffer, and Ryy denotes a correlation between segments existing in the past good frames stored in the buffer.

Next, it is be determined whether the correlation scale accA is within the predetermined range. If this is the case, phase matching erasure concealment processing takes place on the current erased frame. Otherwise, the conventional OLA processing on the current frame is performed. If the correlation scale accA is less than 0.5 or greater than 1.5, the conventional OLA processing is performed. Otherwise, phase matching erasure concealment processing is performed. Herein, the upper limit value and the lower limit value are only illustrative, and may be set in advance as optimal values through experiments or simulations.

First, a matching segment, which has the maximum correlation to, i.e. is most similar to, a search segment adjacent to a current frame is searched for from a decoded signal in a previous good frame from among N past good frames stored in a buffer. For a current erased frame for which it is determined that phase matching erasure concealment processing is performed, it may be again determined whether the phase matching erasure concealment processing is proper by obtaining a correlation scale.

Next, by referring to a position index of the matching segment obtained as a result of the search, a predetermined duration starting from an end of the matching segment is copied to the current frame that is an erasure frame. In addition, when a previous frame is a random erased frame and phase matching erasure concealment processing is performed on the previous frame, by referring to a position index of the matching segment obtained as a result of the search, a predetermined duration starting from an end of the matching segment is copied to the current frame that is an erasure frame. At this time, a duration corresponding to a window length is copied to the current frame. When the copy starting from the end of the matching segment is shorter than the window length, the copy, starting from the end of the matching segment will be repeatedly copied into the current frame.

Next, smoothing processing may be performed through OLA to minimize the discontinuity between the current frame and adjacent frames to generate a time domain signal on the concealed current frame.

Figure 8:
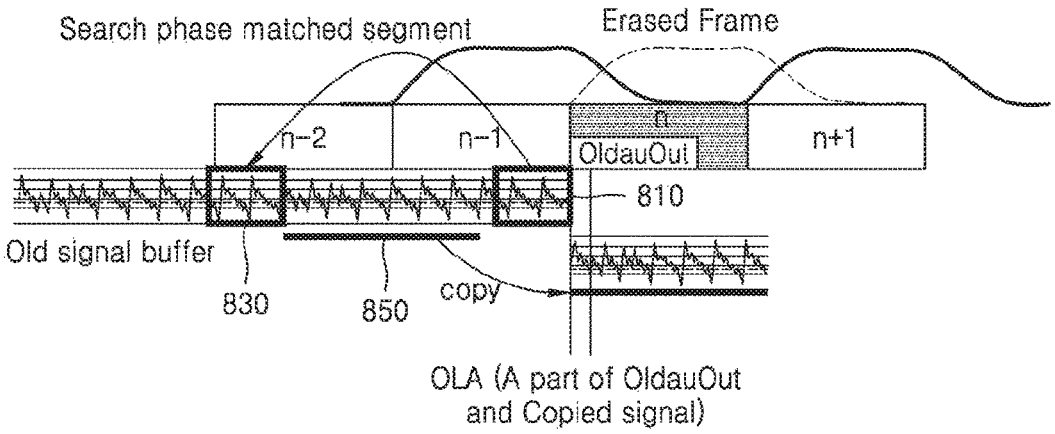
FIG. 8 is a diagram for describing the concept of a phase matching method which is applied to an exemplary embodiment.

FIG. 8 is a diagram for describing the concept of a phase matching method which is applied to an exemplary embodiment.

Referring to FIG. 8, when an error occurs in a frame n in a decoded audio signal, a matching segment 830, which is most similar to a search segment 810 adjacent to the frame n, may be searched for from a decoded signal in a previous frame n−1 from among N past normal frames stored in a buffer. At this time, a size of the search segment 810 and a search range in the buffer may be determined according to a wavelength of a minimum frequency corresponding to a tonal component to be searched for. To minimize the complexity of a search, the size of the search segment 810 is preferably small. For example, the size of the search segment 810 may be set greater than a half of the wavelength of the minimum frequency and less than the wavelength of the minimum frequency. The search range in the buffer may be set equal to or greater than the wavelength of the minimum frequency to be searched. According to an embodiment of the present invention, the size of the search segment 810 and the search range in the buffer may be set in advance according to an input band (NB, WB, SWB, or FB) based on the criterions described above.

In detail, the matching segment 830 having the highest cross-correlation to the search segment 810 may be searched for from among past decoded signals within the search range, location information corresponding to the matching segment 830 may be obtained, and a predetermined duration 850 starting from an end of the matching segment 830 may be set by considering a window length, e.g., a length obtained by adding a frame length and a length of an overlap duration, and copied to the frame n in which an error has occurred.

When the copy process is completed, the overlapping process on a copied signal and on an Oldauout signal stored in the previous frame n−1 for overlapping is performed at the beginning part of the current frame n by a first overlap duration. The length of the overlap duration may be set to 2 ms.

Figure 9:
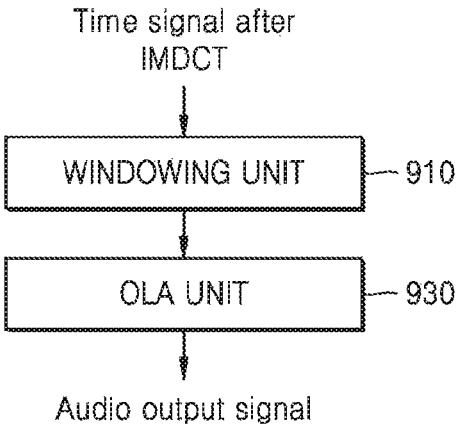
FIG. 9 is a block diagram of conventional OLA unit.

FIG. 9 is a block diagram of a conventional OLA unit. The conventional OLA unit may include a windowing unit 910 and an overlap and add (OLA) unit 930.

Referring to FIG. 9, the windowing unit 910 may perform a windowing process on an IMDCT signal of the current frame to remove time domain aliasing. According to an embodiment, a window having an overlap duration less than 50% may be applied.

The OLA unit 930 may perform OLA processing on the windowed IMDCT signal.

Figure 10:
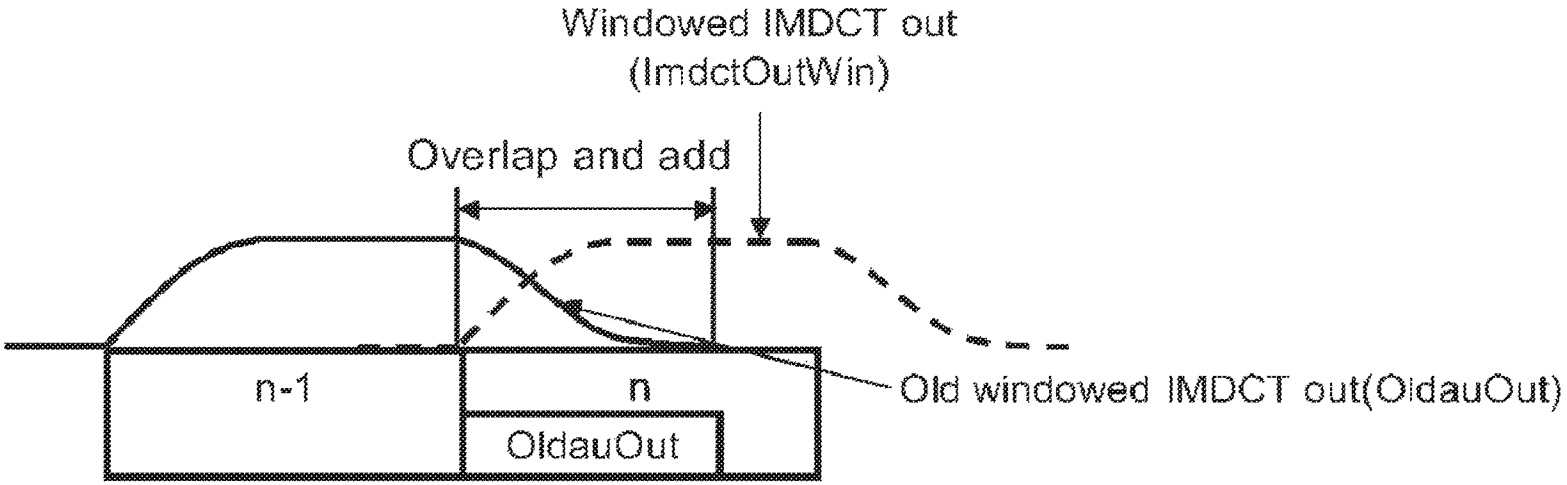
FIG. 10 illustrates the general OLA method.

FIG. 10 illustrates the general OLA method.

When an erasure occurs in frequency domain encoding, past spectral coefficients are usually repeated, and thus, it may be impossible to remove time domain aliasing in the erased frame.

Figure 11:
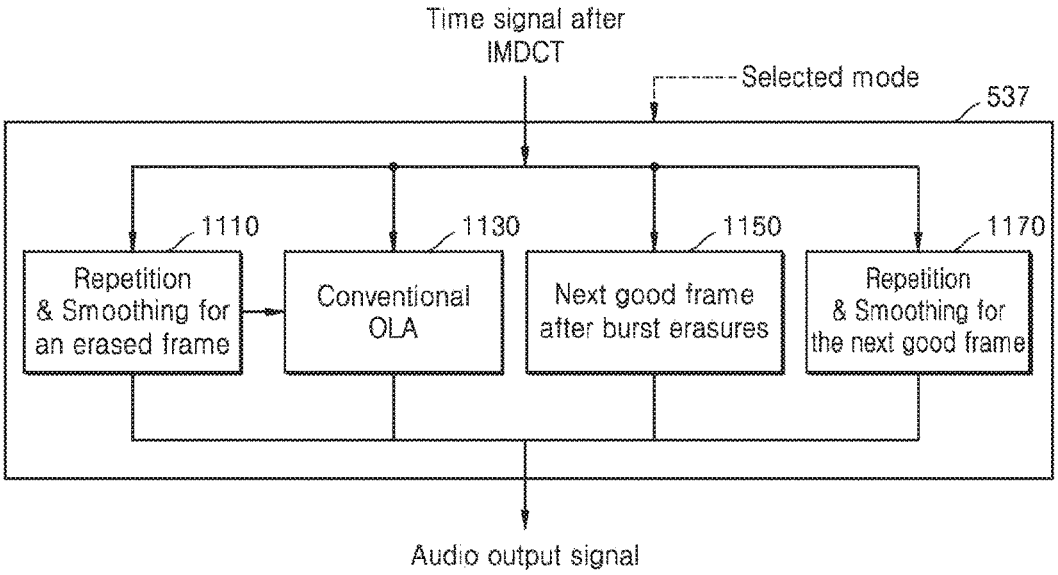
FIG. 11 is a block diagram of a repetition and smoothing erasure concealment apparatus according to an exemplary embodiment.

FIG. 11 is a block diagram of a repetition and smoothing erasure concealment apparatus according to an exemplary embodiment.

The apparatus of FIG. 11 may include first to third concealment units 1110, 1130 and 1170 and an OLA unit 1190.

The operation of the first concealment unit 1110 and the OLA unit 1190 will be explained with reference to FIGS. 12 and 13.

The operation of the second concealment unit 1130 will be explained with reference to FIGS. 16 to 19.

The operation of the third concealment unit 1150 will be explained with reference to FIGS. 14 and 15.

Figure 12:
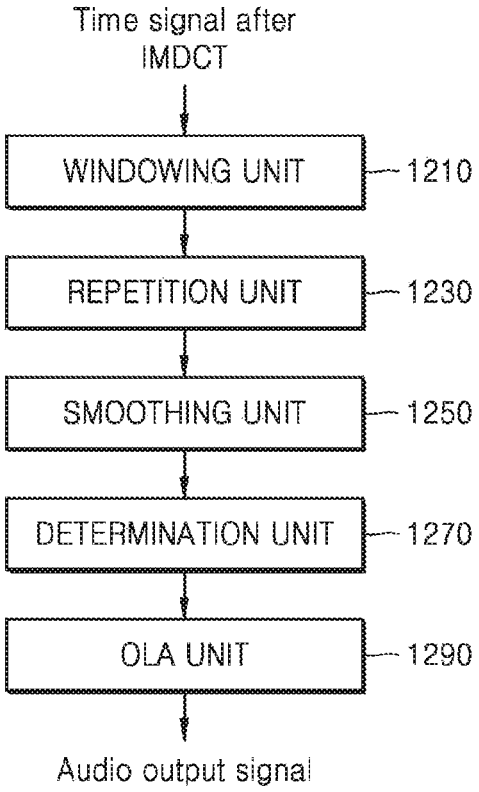
FIG. 12 is a block diagram of the first concealment unit 1110 and the OLA unit 1190 according to an exemplary embodiment.

FIG. 12 is a block diagram of the first concealment unit 1110 and the OLA unit 1190 according to an exemplary embodiment. The apparatus of FIG. 12 may include a windowing unit 1210, a repetition unit 1230, a smoothing unit 1250, a determination unit 1270 and an OLA unit 1290 (1130 of FIG. 11). The repletion and smoothing processing is used to minimize the occurrence of noise even though the original repetition method is used.

Referring to FIG. 12, the windowing unit 1210 may perform the same operation as that of the windowing unit 910 of FIG. 9.

The repetition unit 1230 may apply an IMDCT signal of a frame that is two frames previous to the current frame (referred to as "previous old" in FIG. 13) to a beginning part of the current erased frame.

The smoothing unit 1250 may apply a smoothing window between the signal of the previous frame (old audio output) and the signal of the current frame (referred to as "current audio output") and performs OLA processing. The smoothing window is formed such that the sum of overlap durations between adjacent windows is equal to one. Examples of a window satisfying this condition are a sine wave window, a window using a primary function, and a Hanning window, but the smoothing window is not limited thereto. According to an exemplary embodiment, the sine wave window may be used, and in this case, a window function w(n) may be represented by Equation 4.

$$w(k) = \sin^2\left(\frac{\pi k}{2 * \mathrm{OV_SIZE}}\right),\ n = 0, \ldots, \mathrm{OV_SIZE} - 1 \tag{4}$$

In Equation 4, OV_SIZE denotes the duration of the overlap to be used in the smoothing processing.

By performing smoothing processing, when the current frame is an erasure, the discontinuity between the previous frame and the current frame, which may occur by using an IMDCT signal copied from the frame that is two frames previous to the current frame instead of an IMDCT signal stored in the previous frame, is prevented.

After completion of the repetition and smoothing, in the determination unit 1270, energy Pow1 of a predetermined duration in an overlapping region may be compared with energy Pow2 of a predetermined duration in a non-overlapping region. In detail, when energy of the overlapping region decreases or highly increases after the error concealment processing, general OLA processing may be performed because the decrease in energy may occur when a phase is reversed in overlapping, and the increase in energy may occur when a phase is maintained in overlapping. When a signal is somewhat stationary, since the concealment performance in repetition and smoothing operation is excellent, if an energy difference between the overlapping region and the non-overlapping region is large, it indicates that a problem is generated due to a phase in overlapping. Therefore, when the difference between energy in an overlapping region and energy in a non-overlapping region is large, a result of the general OLA processing may be adapted instead of a result of the repetition and smoothing processing. When the difference between energy in an overlapping region and energy in a non-overlapping region is not large, a result of the repetition and smoothing processing may be adapted. For example, a comparison may nbe performed by Pow2>Pow1*3. When Pow2>Pow1*3 is satisfied, a result of the general OLA processing of the OLA unit 1290 may be adapted instead of a result of the repetition and smoothing processing. When Pow2>Pow1*3 is not satisfied, a result of the repetition and smoothing processing may be adapted.

The OLA unit 1290 may perform OLA processing on a repeated signal of the repetition unit 1230 and an IMDCT signal of the current signal. As a result, an audio output signal is generated and generation of noises in a starting part of the audio output signal may be reduced. In addition, if scaling is applied with spectrum copying of a previous frame in a frequency domain, generation of noises in a starting part of the current frame may be greatly reduced.

Figure 13:
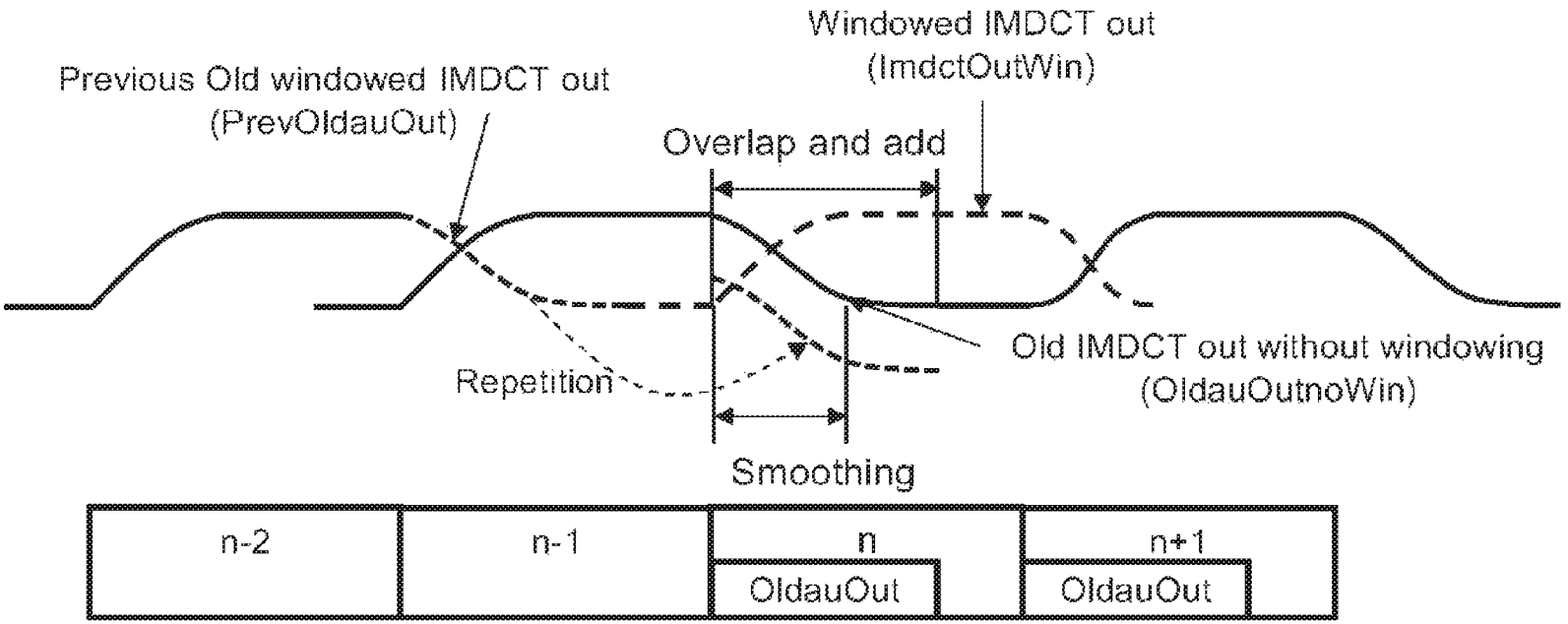
FIG. 13 illustrates windowing in repetition and smoothing processing of an erased frame.

FIG. 13 illustrates windowing in repetition and smoothing processing of an erased frame, which corresponds to an operation of a first concealment unit 1110 in FIG. 11.

Figure 14:
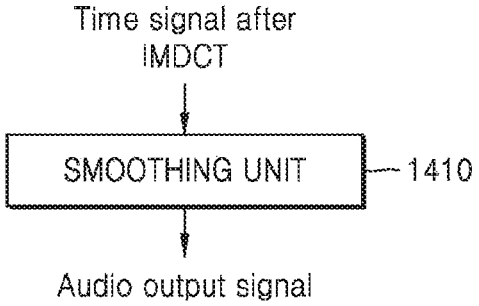
FIG. 14 is a block diagram of a third concealment unit 1170 of FIG. 11.

FIG. 14 is a block diagram of a third concealment unit 1170 and may include a windowing unit 1410.

In FIG. 14, the smoothing unit 1410 may apply the smoothing window to the old IMDCT signal and to a current IMDCT signal and performs OLA processing. Likewise, the smoothing window is formed such that a sum of overlap durations between adjacent windows is equal to one.

That is, when the previous frame is a first erased frame and a current frame is a good frame, it is difficult to remove time domain aliasing in the overlap duration between an IMDCT signal of the previous frame and an IMDCT signal of the current frame. Thus, noise can be minimized by performing the smoothing processing based on the smoothing window instead of the conventional OLA processing.

Figure 15:
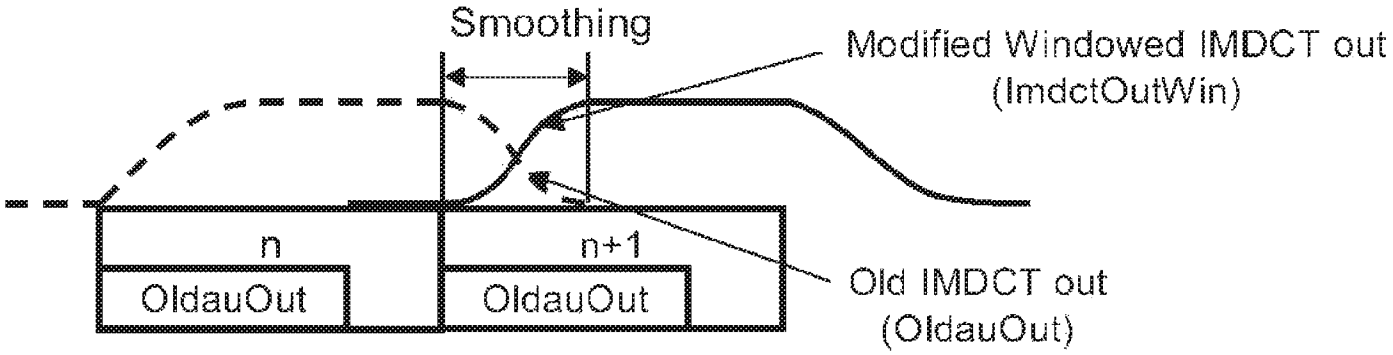
FIG. 15 illustrates the repetition and smoothing method with an example of a window for smoothing the next good frame after an erased frame.

FIG. 15 illustrates the repetition and smoothing method with an example of a window for smoothing the next good frame after an erased frame, which corresponds to an operation of a third concealment unit 1170 in FIG. 11.

Figure 16:
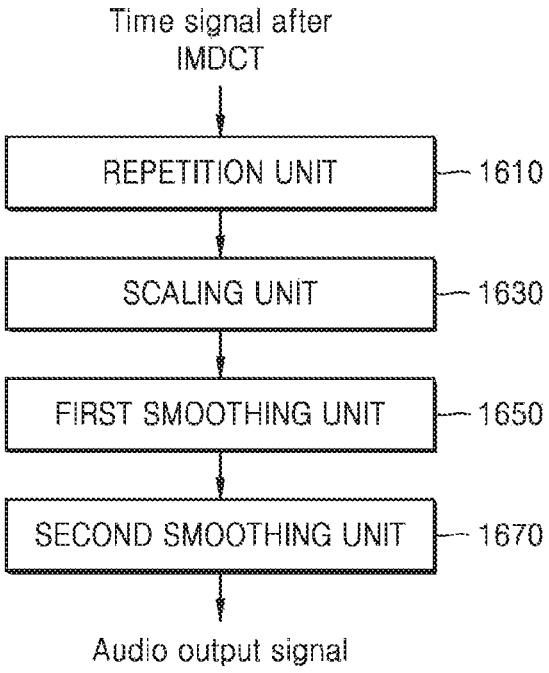
FIG. 16 is a block diagram of a second concealment unit 1170 of FIG. 11.

FIG. 16 is a block diagram of a second concealment unit 1150 of FIG. 11 and may include a repetition unit 1610, a scaling unit 1630, a first smoothing unit 1650 and a second smoothing unit 1670.

Referring to FIG. 16, the repetition unit 1610 may copy, to a beginning part of the current frame, a part used for the next frame of the IMDCT signal of the current frame.

The scaling unit 1630 may adjust the scale of the current frame to prevent a sudden signal increase. In an embodiment, the scaling block performs down-scaling by 3 dB.

The first smoothing unit 1650 may apply a smoothing window to the IMDCT signal of the previous frame and the copied IMDCT signal from a future frame and performs OLA processing. Likewise, the smoothing window is formed such that a sum of overlap durations between adjacent windows is equal to one. That is, when the copied signal is used, windowing is necessary to remove the discontinuity which may occur between the previous frame and the current frame, and an old IMDCT signal may be replaced with a signal obtained by OLA processing of the first smoothing unit 1650.

The second smoothing unit 1670 may perform the OLA processing while removing the discontinuity by applying a smoothing window between the old IMDCT signal that is a replaced signal and a current IMDCT signal that is the current frame signal. Likewise, the smoothing window is formed such that the sum of overlap durations between adjacent windows is equal to one.

That is, when the previous frame is a burst erasure and the current frame is a good frame, time domain aliasing in the overlap duration between the IMDCT signal of the previous frame and the IMDCT signal of the current frame cannot be removed. In the burst erasure frame, since noise may occur due to a decrease in energy or continuous repetitions, the method of copying a signal from the future frame for overlapping with the current frame is applied. In this case, smoothing processing is performed twice to remove the noise which may occur in the current frame and simultaneously remove the discontinuity which occurs between the previous frame and the current frame.

Figure 17:
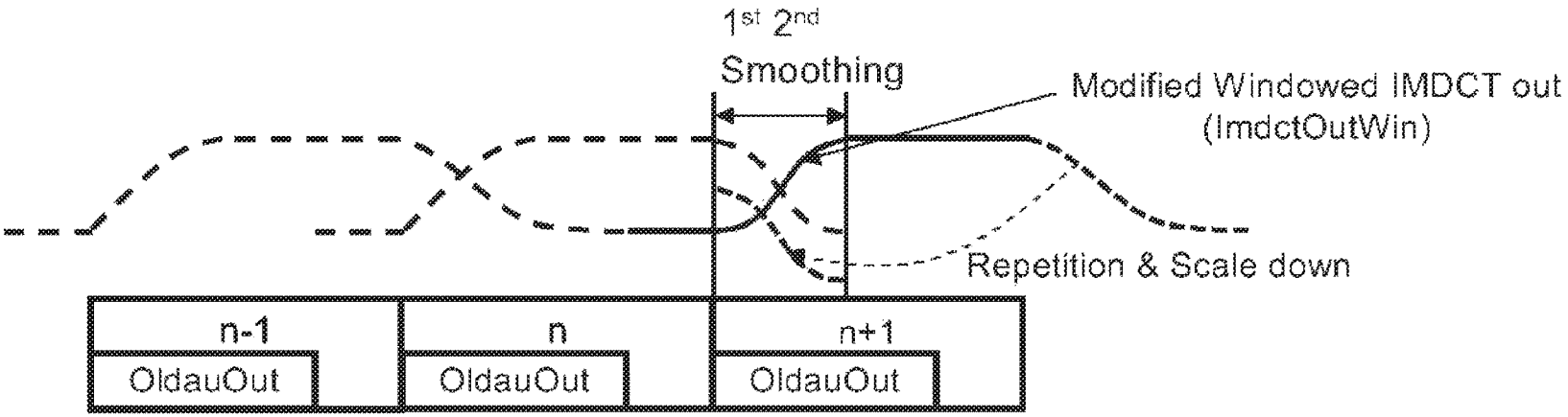
FIG. 17 illustrates windowing in repetition and smoothing processing for smoothing the next good frame after burst erasures in FIG. 16.

FIG. 17 illustrates windowing in repetition and smoothing processing for the next good frame after burst erasures in FIG. 16.

Figure 18:
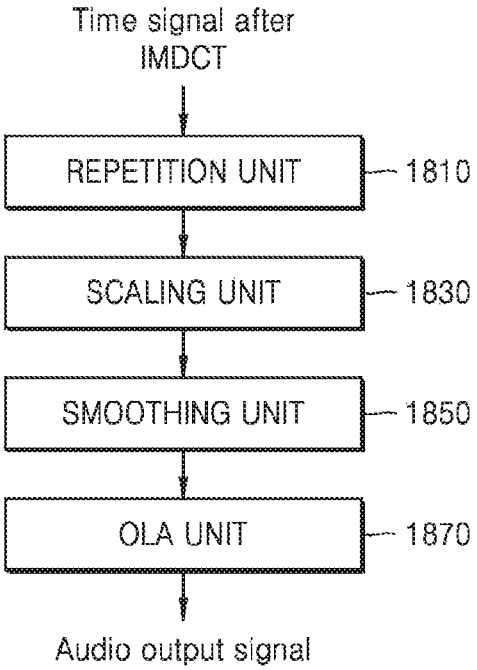
FIG. 18 is a block diagram of a second concealment unit 1170 of FIG. 11.

FIG. 18 is a block diagram of a second concealment unit 1170 of FIG. 11 and may include a repetition unit 1810, a scaling unit 1830, a smoothing unit 1650 and an OLA unit 1870.

Referring to FIG. 18, the repetition unit 1810 may copy, to a beginning part of the current frame, a part used for the next frame of the IMDCT signal of the current frame.

The scaling unit 1830 may adjust the scale of the current frame to prevent a sudden signal increase. In an embodiment, the scaling block performs down-scaling by 3 dB.

The first smoothing unit 1850 may apply a smoothing window to the IMDCT signal of the previous frame and the copied IMDCT signal from a future frame and performs OLA processing. Likewise, the smoothing window is formed such that a sum of overlap durations between adjacent windows is equal to one. That is, when the copied signal is used, windowing is necessary to remove the discontinuity which may occur between the previous frame and the current frame, and an old IMDCT signal may be replaced with a signal obtained by OLA processing of the first smoothing unit 1850.

The OLA unit 1870 may perform the OLA processing between the replaced OldauOut signal and the current IMDCT signal.

Figure 19:
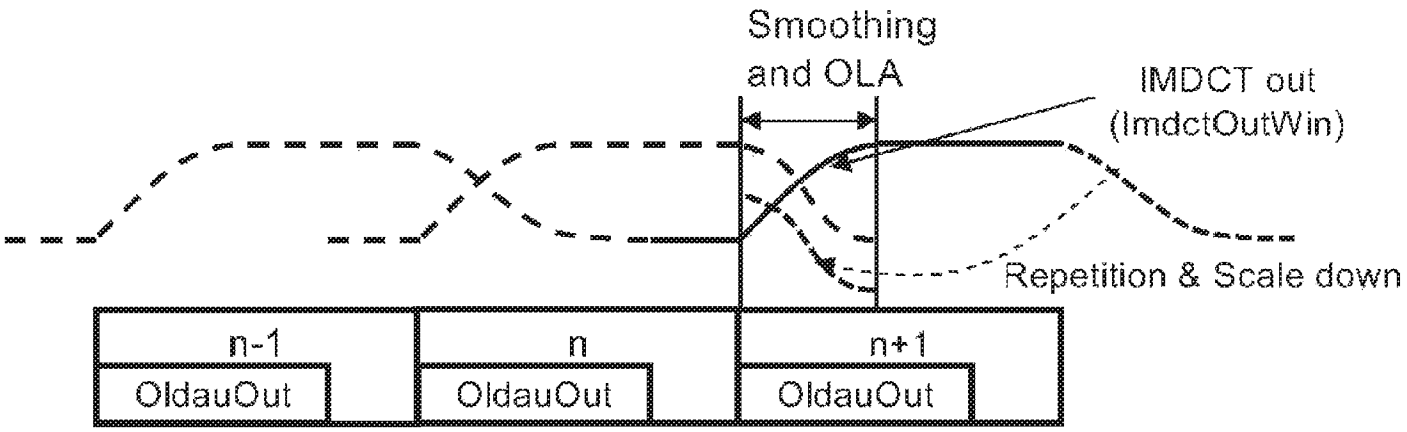
FIG. 19 illustrates windowing in repetition and smoothing processing for the next good frame after burst erasures in FIG. 18.

FIG. 19 illustrates windowing in repetition and smoothing processing for the next good frame after burst erasures in FIG. 18.

Figure 20A:
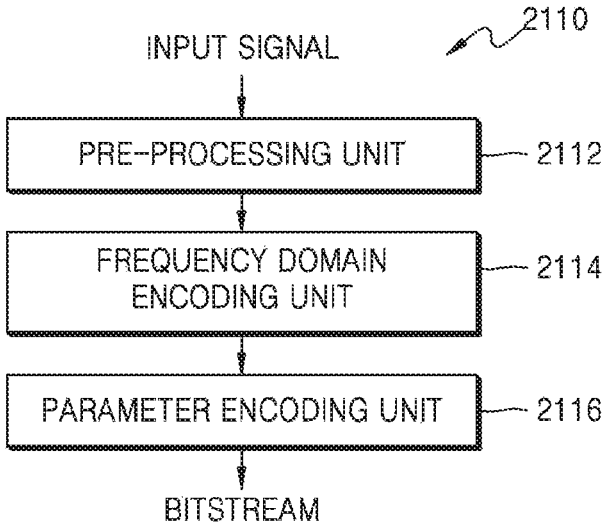
FIGS. 20A and 20B are block diagrams of an audio encoding apparatus and an audio decoding apparatus according to an exemplary embodiment, respectively.
Figure 20B:
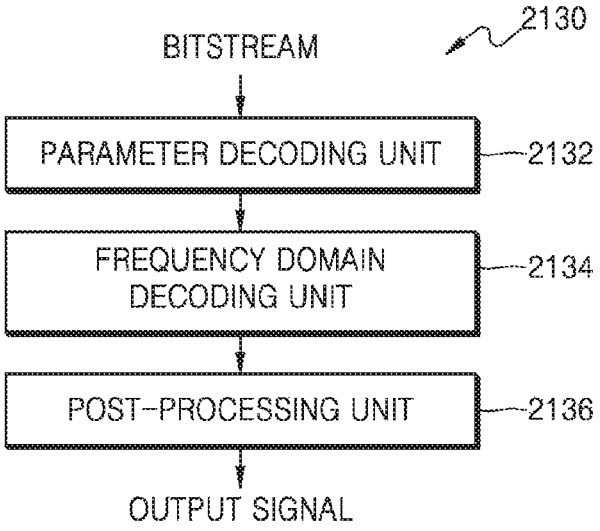

FIGS. 20A and 20B are block diagrams of an audio encoding apparatus and an audio decoding apparatus according to an exemplary embodiment, respectively.

The audio encoding apparatus 2110 shown in FIG. 20A may include a pre-processing unit 2112, a frequency domain encoding unit 2114, and a parameter encoding unit 2116. The components may be integrated in at least one module and may be implemented as at least one processor (not shown).

In FIG. 20A, the pre-processing unit 2112 may perform filtering, down-sampling, or the like for an input signal, but is not limited thereto. The input signal may include a speech signal, a music signal, or a mixed signal of speech and music. Hereinafter, for convenience of description, the input signal is referred to as an audio signal.

The frequency domain encoding unit 2114 may perform a time-frequency transform on the audio signal provided by the pre-processing unit 2112, select a coding tool in correspondence with the number of channels, a coding band, and a bit rate of the audio signal, and encode the audio signal by using the selected coding tool. The time-frequency transform uses a modified discrete cosine transform (MDCT), a modulated lapped transform (MLT), or a fast Fourier transform (FFT), but is not limited thereto. When the number of given bits is sufficient, a general transform coding scheme may be applied to the whole bands, and when the number of given bits is not sufficient, a bandwidth extension scheme may be applied to partial bands. When the audio signal is a stereo-channel or multi-channel, if the number of given bits is sufficient, encoding is performed for each channel, and if the number of given bits is not sufficient, a down-mixing scheme may be applied. An encoded spectral coefficient is generated by the frequency domain encoding unit 2114.

The parameter encoding unit 2116 may extract a parameter from the encoded spectral coefficient provided from the frequency domain encoding unit 2114 and encode the extracted parameter. The parameter may be extracted, for example, for each sub-band, which is a unit of grouping spectral coefficients, and may have a uniform or non-uniform length by reflecting a critical band. When each sub-band has a non-uniform length, a sub-band existing in a low frequency band may have a relatively short length compared with a sub-band existing in a high frequency band. The number and a length of sub-bands included in one frame vary according to codec algorithms and may affect the encoding performance. The parameter may include, for example a scale factor, power, average energy, or Norm, but is not limited thereto. Spectral coefficients and parameters obtained as an encoding result form a bitstream, and the bitstream may be stored in a storage medium or may be transmitted in a form of, for example, packets through a channel.

The audio decoding apparatus 2130 shown in FIG. 20B may include a parameter decoding unit 2132, a frequency domain decoding unit 2134, and a post-processing unit 2136. The frequency domain decoding unit 2134 may include a packet loss concealment algorithm. The components may be integrated in at least one module and may be implemented as at least one processor (not shown).

In FIG. 20B, the parameter decoding unit 2132 may decode parameters from a received bitstream and check whether an erasure has occurred in frame units from the decoded parameters. Various well-known methods may be used for the erasure check, and information on whether a current frame is a good frame or an erasure frame is provided to the frequency domain decoding unit 2134.

When the current frame is a good frame, the frequency domain decoding unit 2134 may generate synthesized spectral coefficients by performing decoding through a general transform decoding process. When the current frame is an erasure frame, the frequency domain decoding unit 2134 may generate synthesized spectral coefficients by scaling spectral coefficients of a previous good frame (PGF) through a packet loss concealment algorithm. The frequency domain decoding unit 2134 may generate a time domain signal by performing a frequency-time transform on the synthesized spectral coefficients.

The post-processing unit 2136 may perform filtering, up-sampling, or the like for sound quality improvement with respect to the time domain signal provided from the frequency domain decoding unit 2134, but is not limited thereto. The post-processing unit 2136 provides a reconstructed audio signal as an output signal.

Figure 21A:
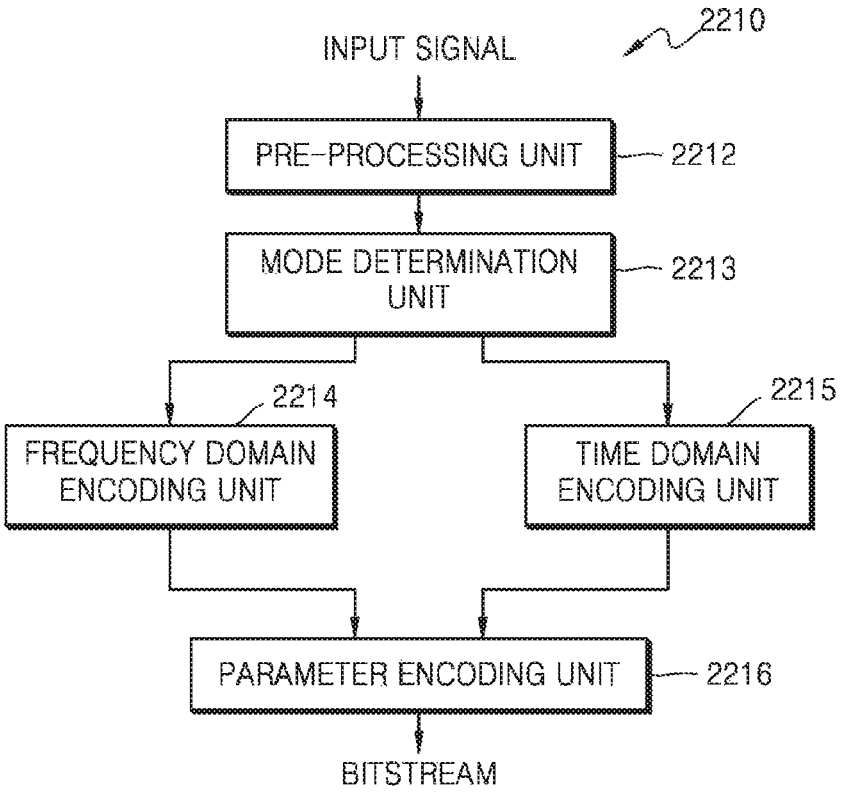
FIGS. 21A and 21B are block diagrams of an audio encoding apparatus and an audio decoding apparatus according to another exemplary embodiment, respectively.
Figure 21B:
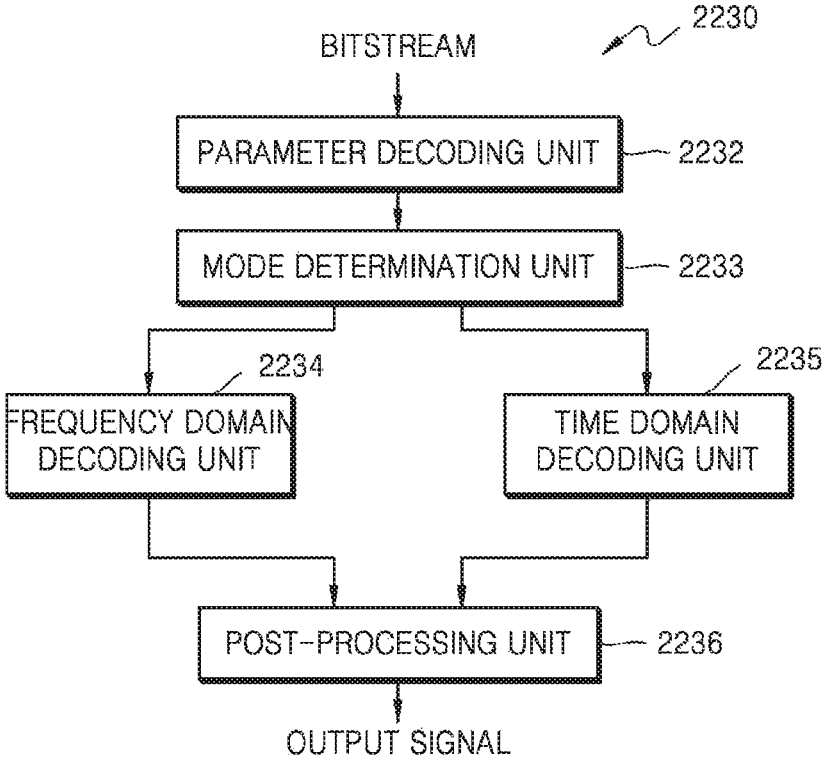

FIGS. 21A and 21B are block diagrams of an audio encoding apparatus and an audio decoding apparatus, according to another exemplary embodiment, respectively, which have a switching structure.

The audio encoding apparatus 2210 shown in FIG. 21A may include a pre-processing unit 2212, a mode determination unit 2213, a frequency domain encoding unit 2214, a time domain encoding unit 2215, and a parameter encoding unit 2216. The components may be integrated in at least one module and may be implemented as at least one processor (not shown).

In FIG. 21A, since the pre-processing unit 2212 is substantially the same as the pre-processing unit 2112 of FIG. 20A, the description thereof is not repeated.

The mode determination unit 2213 may determine a coding mode by referring to a characteristic of an input signal. The mode determination unit 2213 may determine according to the characteristic of the input signal whether a coding mode suitable for a current frame is a speech mode or a music mode and may also determine whether a coding mode efficient for the current frame is a time domain mode or a frequency domain mode. The characteristic of the input signal may be perceived by using a short-term characteristic of a frame or a long-term characteristic of a plurality of frames, but is not limited thereto. For example, if the input signal corresponds to a speech signal, the coding mode may be determined as the speech mode or the time domain mode, and if the input signal corresponds to a signal other than a speech signal, i.e., a music signal or a mixed signal, the coding mode may be determined as the music mode or the frequency domain mode. The mode determination unit 2213 may provide an output signal of the pre-processing unit 2212 to the frequency domain encoding unit 2214 when the characteristic of the input signal corresponds to the music mode or the frequency domain mode and may provide an output signal of the pre-processing unit 2212 to the time domain encoding unit 215 when the characteristic of the input signal corresponds to the speech mode or the time domain mode.

Since the frequency domain encoding unit 2214 is substantially the same as the frequency domain encoding unit 2114 of FIG. 20A, the description thereof is not repeated.

The time domain encoding unit 2215 may perform code excited linear prediction (CELP) coding for an audio signal provided from the pre-processing unit 2212. In detail, algebraic CELP may be used for the CELP coding, but the CELP coding is not limited thereto. An encoded spectral coefficient is generated by the time domain encoding unit 2215.

The parameter encoding unit 2216 may extract a parameter from the encoded spectral coefficient provided from the frequency domain encoding unit 2214 or the time domain encoding unit 2215 and encodes the extracted parameter. Since the parameter encoding unit 2216 is substantially the same as the parameter encoding unit 2116 of FIG. 20A, the description thereof is not repeated. Spectral coefficients and parameters obtained as an encoding result may form a bitstream together with coding mode information, and the bitstream may be transmitted in a form of packets through a channel or may be stored in a storage medium.

The audio decoding apparatus 2230 shown in FIG. 21B may include a parameter decoding unit 2232, a mode determination unit 2233, a frequency domain decoding unit 2234, a time domain decoding unit 2235, and a post-processing unit 2236. Each of the frequency domain decoding unit 2234 and the time domain decoding unit 2235 may include a packet loss concealment algorithm in each corresponding domain. The components may be integrated in at least one module and may be implemented as at least one processor (not shown).

In FIG. 21B, the parameter decoding unit 2232 may decode parameters from a bitstream transmitted in a form of packets and check whether an erasure has occurred in frame units from the decoded parameters. Various well-known methods may be used for the erasure check, and information on whether a current frame is a good frame or an erasure frame is provided to the frequency domain decoding unit 2234 or the time domain decoding unit 2235.

The mode determination unit 2233 may check coding mode information included in the bitstream and provide a current frame to the frequency domain decoding unit 2234 or the time domain decoding unit 2235.

The frequency domain decoding unit 2234 may operate when a coding mode is the music mode or the frequency domain mode and generate synthesized spectral coefficients by performing decoding through a general transform decoding process when the current frame is a good frame. When the current frame is an erasure frame, and a coding mode of a previous frame is the music mode or the frequency domain mode, the frequency domain decoding unit 2234 may generate synthesized spectral coefficients by scaling spectral coefficients of a PGF through an erasure concealment algorithm. The frequency domain decoding unit 2234 may generate a time domain signal by performing a frequency-time transform on the synthesized spectral coefficients.

The time domain decoding unit 2235 may operate when the coding mode is the speech mode or the time domain mode and generate a time domain signal by performing decoding through a general CELP decoding process when the current frame is a good frame. When the current frame is an erasure frame, and the coding mode of the previous frame is the speech mode or the time domain mode, the time domain decoding unit 2235 may perform an erasure concealment algorithm in the time domain.

The post-processing unit 2236 may perform filtering, up-sampling, or the like for the time domain signal provided from the frequency domain decoding unit 2234 or the time domain decoding unit 2235, but is not limited thereto. The post-processing unit 2236 provides a reconstructed audio signal as an output signal.

Figure 22A:
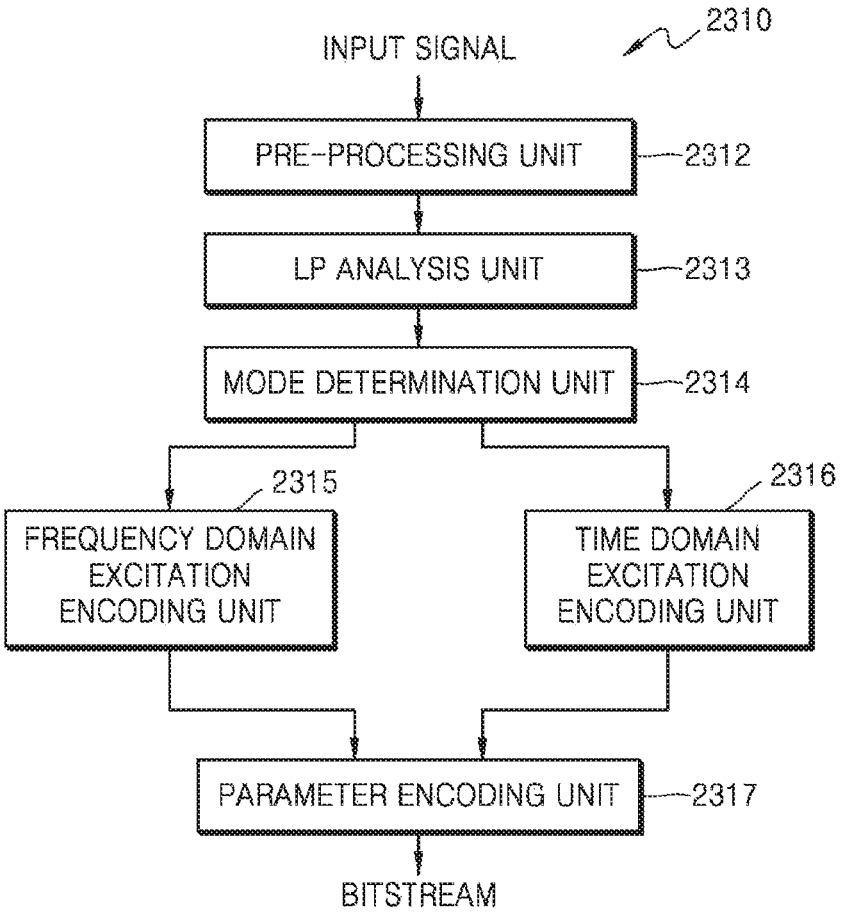
FIGS. 22A and 22B are block diagrams of an audio encoding apparatus and an audio decoding apparatus according to another exemplary embodiment, respectively.
Figure 22B:
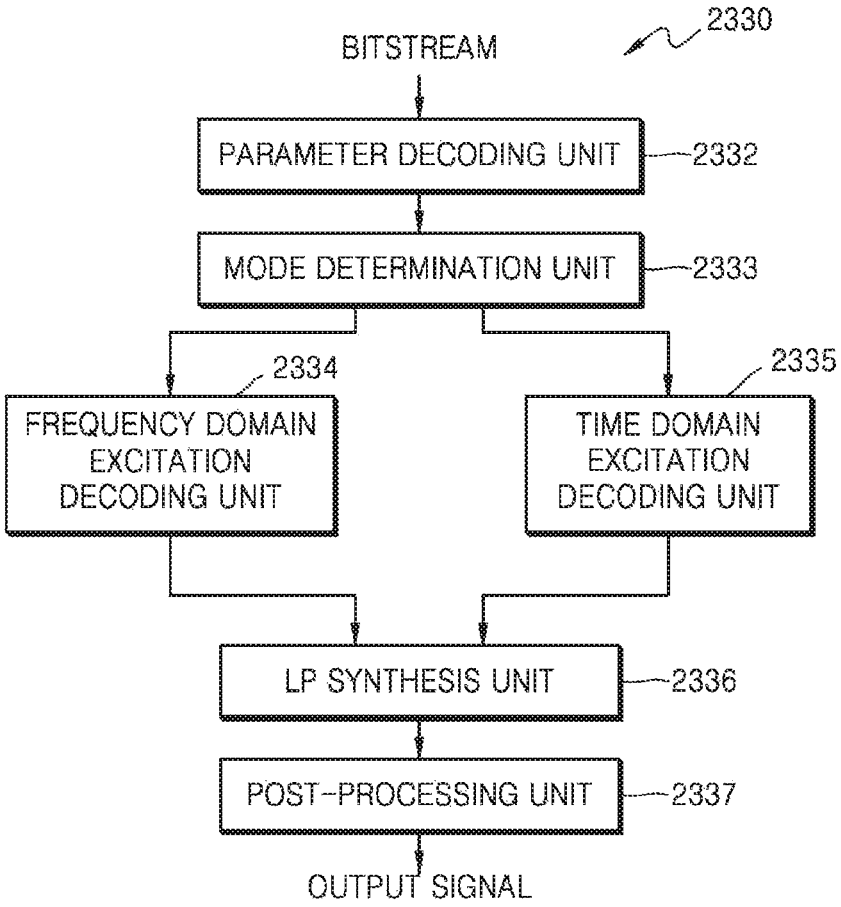

FIGS. 22A and 22B are block diagrams of an audio encoding apparatus 2310 and an audio decoding apparatus 2320 according to another exemplary embodiment, respectively.

The audio encoding apparatus 2310 shown in FIG. 22A may include a pre-processing unit 2312, a linear prediction (LP) analysis unit 2313, a mode determination unit 2314, a frequency domain excitation encoding unit 2315, a time domain excitation encoding unit 2316, and a parameter encoding unit 2317. The components may be integrated in at least one module and may be implemented as at least one processor (not shown).

In FIG. 22A, since the pre-processing unit 2312 is substantially the same as the pre-processing unit 2112 of FIG. 20A, the description thereof is not repeated.

The LP analysis unit 2313 may extract LP coefficients by performing LP analysis for an input signal and generate an excitation signal from the extracted LP coefficients. The excitation signal may be provided to one of the frequency domain excitation encoding unit 2315 and the time domain excitation encoding unit 2316 according to a coding mode.

Since the mode determination unit 2314 is substantially the same as the mode determination unit 2213 of FIG. 21A, the description thereof is not repeated.

The frequency domain excitation encoding unit 2315 may operate when the coding mode is the music mode or the frequency domain mode, and since the frequency domain excitation encoding unit 2315 is substantially the same as the frequency domain encoding unit 2114 of FIG. 20A except that an input signal is an excitation signal, the description thereof is not repeated.

The time domain excitation encoding unit 2316 may operate when the coding mode is the speech mode or the time domain mode, and since the time domain excitation encoding unit 2316 is substantially the same as the time domain encoding unit 2215 of FIG. 21A, the description thereof is not repeated.

The parameter encoding unit 2317 may extract a parameter from an encoded spectral coefficient provided from the frequency domain excitation encoding unit 2315 or the time domain excitation encoding unit 2316 and encode the extracted parameter. Since the parameter encoding unit 2317 is substantially the same as the parameter encoding unit 2116 of FIG. 20A, the description thereof is not repeated. Spectral coefficients and parameters obtained as an encoding result may form a bitstream together with coding mode information, and the bitstream may be transmitted in a form of packets through a channel or may be stored in a storage medium.

The audio decoding apparatus 2330 shown in FIG. 22B may include a parameter decoding unit 2332, a mode determination unit 2333, a frequency domain excitation decoding unit 2334, a time domain excitation decoding unit 2335, an LP synthesis unit 2336, and a post-processing unit 2337. Each of the frequency domain excitation decoding unit 2334 and the time domain excitation decoding unit 2335 may include a packet loss concealment algorithm in each corresponding domain. The components may be integrated in at least one module and may be implemented as at least one processor (not shown).

In FIG. 22B, the parameter decoding unit 2332 may decode parameters from a bitstream transmitted in a form of packets and check whether an erasure has occurred in frame units from the decoded parameters. Various well-known methods may be used for the erasure check, and information on whether a current frame is a good frame or an erasure frame is provided to the frequency domain excitation decoding unit 2334 or the time domain excitation decoding unit 2335.

The mode determination unit 2333 may check coding mode information included in the bitstream and provide a current frame to the frequency domain excitation decoding unit 2334 or the time domain excitation decoding unit 2335.

The frequency domain excitation decoding unit 2334 may operate when a coding mode is the music mode or the frequency domain mode and generate synthesized spectral coefficients by performing decoding through a general transform decoding process when the current frame is a good frame. When the current frame is an erasure frame, and a coding mode of a previous frame is the music mode or the frequency domain mode, the frequency domain excitation decoding unit 2334 may generate synthesized spectral coefficients by scaling spectral coefficients of a PGF through a packet loss concealment algorithm. The frequency domain excitation decoding unit 2334 may generate an excitation signal that is a time domain signal by performing a frequency-time transform on the synthesized spectral coefficients.

The time domain excitation decoding unit 2335 may operate when the coding mode is the speech mode or the time domain mode and generate an excitation signal that is a time domain signal by performing decoding through a general CELP decoding process when the current frame is a good frame. When the current frame is an erasure frame, and the coding mode of the previous frame is the speech mode or the time domain mode, the time domain excitation decoding unit 2335 may perform a packet loss concealment algorithm in the time domain.

The LP synthesis unit 2336 may generate a time domain signal by performing LP synthesis for the excitation signal provided from the frequency domain excitation decoding unit 2334 or the time domain excitation decoding unit 2335.

The post-processing unit 2337 may perform filtering, up-sampling, or the like for the time domain signal provided from the LP synthesis unit 2336, but is not limited thereto. The post-processing unit 2337 provides a reconstructed audio signal as an output signal.

Figure 23A:
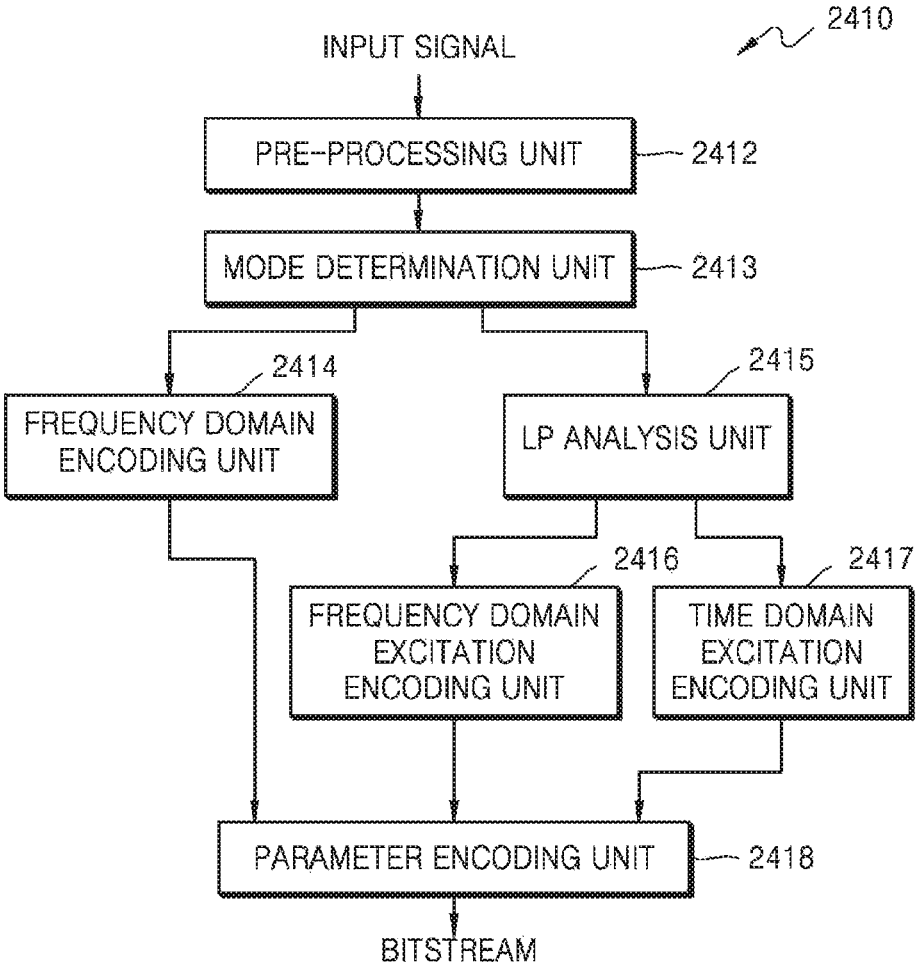
FIGS. 23A and 23B are block diagrams of an audio encoding apparatus and an audio decoding apparatus according to another exemplary embodiment, respectively.
Figure 23B:
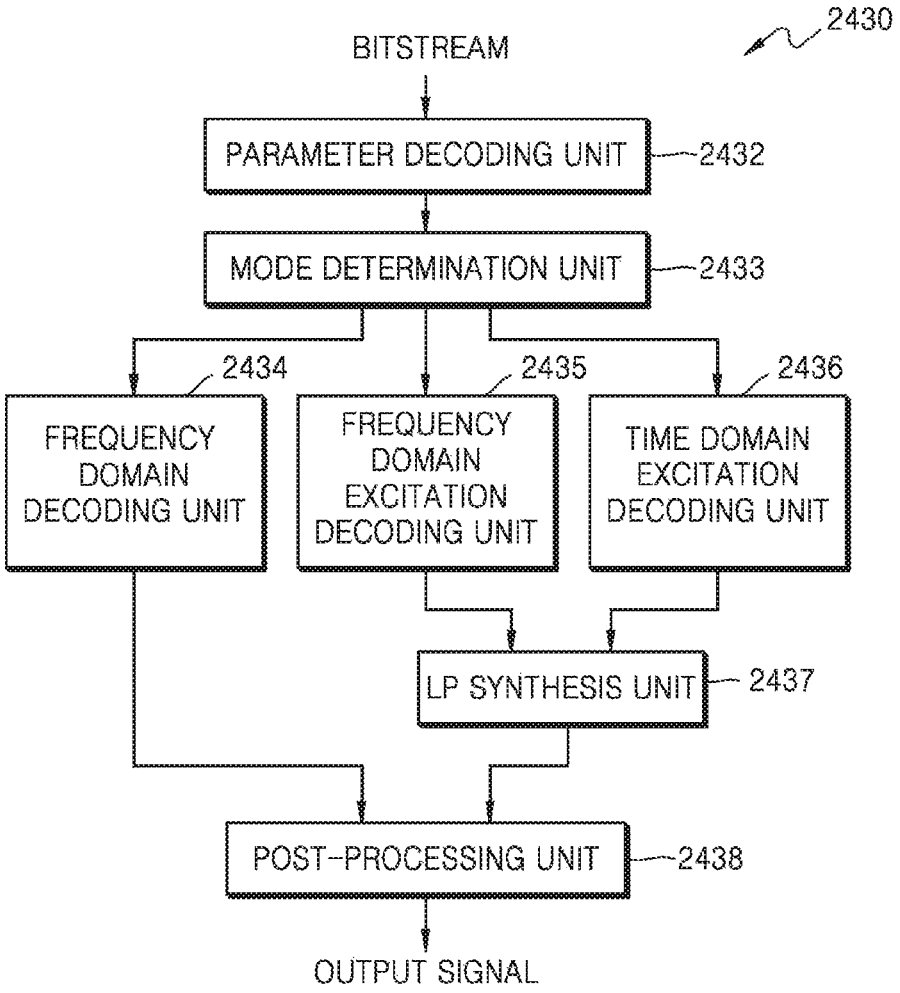

FIGS. 23A and 23B are block diagrams of an audio encoding apparatus 2410 and an audio decoding apparatus 2430 according to another exemplary embodiment, respectively, which have a switching structure.

The audio encoding apparatus 2410 shown in FIG. 23A may include a pre-processing unit 2412, a mode determination unit 2413, a frequency domain encoding unit 2414, an LP analysis unit 2415, a frequency domain excitation encoding unit 2416, a time domain excitation encoding unit 2417, and a parameter encoding unit 2418. The components may be integrated in at least one module and may be implemented as at least one processor (not shown). Since it can be considered that the audio encoding apparatus 2410 shown in FIG. 23A is obtained by combining the audio encoding apparatus 2210 of FIG. 21A and the audio encoding apparatus 2310 of FIG. 22A, the description of operations of common parts is not repeated, and an operation of the mode determination unit 2413 will now be described.

The mode determination unit 2413 may determine a coding mode of an input signal by referring to a characteristic and a bit rate of the input signal. The mode determination unit 2413 may determine the coding mode as a CELP mode or another mode based on whether a current frame is the speech mode or the music mode according to the characteristic of the input signal and based on whether a coding mode efficient for the current frame is the time domain mode or the frequency domain mode. The mode determination unit 2413 may determine the coding mode as the CELP mode when the characteristic of the input signal corresponds to the speech mode, determine the coding mode as the frequency domain mode when the characteristic of the input signal corresponds to the music mode and a high bit rate, and determine the coding mode as an audio mode when the characteristic of the input signal corresponds to the music mode and a low bit rate. The mode determination unit 2413 may provide the input signal to the frequency domain encoding unit 2414 when the coding mode is the frequency domain mode, provide the input signal to the frequency domain excitation encoding unit 2416 via the LP analysis unit 2415 when the coding mode is the audio mode, and provide the input signal to the time domain excitation encoding unit 2417 via the LP analysis unit 2415 when the coding mode is the CELP mode.

The frequency domain encoding unit 2414 may correspond to the frequency domain encoding unit 2114 in the audio encoding apparatus 2110 of FIG. 20A or the frequency domain encoding unit 2214 in the audio encoding apparatus 2210 of FIG. 21A, and the frequency domain excitation encoding unit 2416 or the time domain excitation encoding unit 2417 may correspond to the frequency domain excitation encoding unit 2315 or the time domain excitation encoding unit 2316 in the audio encoding apparatus 2310 of FIG. 22A.

The audio decoding apparatus 2430 shown in FIG. 23B may include a parameter decoding unit 2432, a mode determination unit 2433, a frequency domain decoding unit 2434, a frequency domain excitation decoding unit 2435, a time domain excitation decoding unit 2436, an LP synthesis unit 2437, and a post-processing unit 2438. Each of the frequency domain decoding unit 2434, the frequency domain excitation decoding unit 2435, and the time domain excitation decoding unit 2436 may include a packet loss concealment algorithm in each corresponding domain. The components may be integrated in at least one module and may be implemented as at least one processor (not shown). Since it can be considered that the audio decoding apparatus 2430 shown in FIG. 23B is obtained by combining the audio decoding apparatus 2230 of FIG. 21B and the audio decoding apparatus 2330 of FIG. 22B, the description of operations of common parts is not repeated, and an operation of the mode determination unit 2433 will now be described.

The mode determination unit 2433 may check coding mode information included in a bitstream and provide a current frame to the frequency domain decoding unit 2434, the frequency domain excitation decoding unit 2435, or the time domain excitation decoding unit 2436.

The frequency domain decoding unit 2434 may correspond to the frequency domain decoding unit 2134 in the audio decoding apparatus 2130 of FIG. 20B or the frequency domain decoding unit 2234 in the audio encoding apparatus 2230 of FIG. 21B, and the frequency domain excitation decoding unit 2435 or the time domain excitation decoding unit 2436 may correspond to the frequency domain excitation decoding unit 2334 or the time domain excitation decoding unit 2335 in the audio decoding apparatus 2330 of FIG. 22B.

The above-described exemplary embodiments may be written as computer-executable programs and may be implemented in general-use digital computers that execute the programs by using a non-transitory computer-readable recording medium. In addition, data structures, program instructions, or data files, which can be used in the embodiments, can be recorded on a non-transitory computer-readable recording medium in various ways. The non-transitory computer-readable recording medium is any data storage device that can store data which can be thereafter read by a computer system. Examples of the non-transitory computer-readable recording medium include magnetic storage media, such as hard disks, floppy disks, and magnetic tapes, optical recording media, such as CD-ROMs and DVDs, magneto-optical media, such as optical disks, and hardware devices, such as ROM, RAM, and flash memory, specially configured to store and execute program instructions. In addition, the non-transitory computer-readable recording medium may be a transmission medium for transmitting signal designating program instructions, data structures, or the like. Examples of the program instructions may include not only mechanical language codes created by a compiler but also high-level language codes executable by a computer using an interpreter or the like.

While the exemplary embodiments have been particularly shown and described, it will be understood by those of ordinary skill in the art that various changes in form and details may be made therein without departing from the spirit and scope of the inventive concept as defined by the appended claims. It should be understood that the exemplary embodiments described therein should be considered in a descriptive sense only and not for purposes of limitation. Descriptions of features or aspects within each exemplary embodiment should typically be considered as available for other similar features or aspects in other exemplary embodiments.

The invention claimed is:

1. A method for time domain packet loss concealment for an audio signal comprising:

checking whether or not a current frame corresponds to one of an erased frame and a good frame after an erased frame;

if the current frame corresponds to one of the erased frame and the good frame after the erased frame, obtaining signal characteristics;

selecting one tool among a plurality of tools including a phase matching tool and a smoothing tool, based on a plurality of parameters including the signal characteristics; and performing a packet loss concealment processing on the current frame based on the selected tool, wherein if the selected tool is the smoothing tool and the current frame corresponds to the erased frame, a first smoothing processing is performed as the packet loss concealment processing, and if the selected tool is the smoothing tool and the current frame corresponds to the good frame after the erased frame, a second smoothing processing is performed as the packet loss concealment processing, wherein the first smoothing processing includes an overlap and add (OLA) processing, wherein the second smoothing processing does not include the OLA processing, and wherein the current frame corresponds to a time signal after a time-frequency inverse transform processing.

2. The method of claim 1, wherein the signal characteristics is based on stationarity of the current frame.

3. The method of claim 1, wherein the plurality of parameters includes a first parameter which is generated to determine whether the phase matching tool is applied to a next erasure frame at every good frame, and a second parameter which is generated according to whether the phase matching tool is used in a previous frame of the current frame.

4. The method of claim 3, wherein the first parameter is obtained based on a sub-band having a maximum energy in the current frame and an inter-frame index.

5. The method of claim 1, wherein the phase matching tool is selected for a good frame after a previous erasure frame, when the phase matching tool is applied to the previous erasure frame.

6. The method of claim 1, wherein an energy change level between an overlap duration and a non-overlap duration as a result of the smoothing processing is compared with a predetermined threshold, and the OLA processing is performed instead of a smoothing processing as a result of the comparison.

7. The method of claim 1, wherein when the current frame is the erased frame, the smoothing tool is configured to perform a windowing processing on a signal of the current frame after the time-frequency inverse transform processing, repeat a signal before two frames at a beginning part of the current frame after the time-frequency inverse transform processing, perform the OLA processing on the signal repeated at the beginning part of the current frame and the signal of the current frame, and perform the OLA processing by applying a smoothing window having a predetermined overlap duration between a signal of a previous frame and the signal of the current frame.

8. The method of claim 1, wherein when a previous frame is a random erasure frame and the current frame is a good frame, the smoothing tool is configured to perform the OLA processing by applying a smoothing window between a signal of the previous frame and a signal of the current frame, after the time-frequency inverse transform processing.

* * * * *